US010364118B2

(12) United States Patent
Ishikawa et al.

(10) Patent No.: US 10,364,118 B2
(45) Date of Patent: Jul. 30, 2019

(54) SHEET POST-PROCESSING APPARATUS

(71) Applicants: KABUSHIKI KAISHA TOSHIBA, Tokyo (JP); TOSHIBA TEC KABUSHIKI KAISHA, Tokyo (JP)

(72) Inventors: Misato Ishikawa, Kawasaki Kanagawa (JP); Takamitsu Sunaoshi, Yokohama Kanagawa (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/787,240

(22) Filed: Oct. 18, 2017

(65) Prior Publication Data

US 2018/0362284 A1 Dec. 20, 2018

(30) Foreign Application Priority Data

Jun. 20, 2017 (JP) ..... 2017-120898

(51) Int. Cl.

| | |
|---|---|
| ***B65H 31/10*** | (2006.01) |
| ***B65H 31/18*** | (2006.01) |
| ***B65H 31/14*** | (2006.01) |
| ***B65H 43/06*** | (2006.01) |

(52) U.S. Cl.

CPC ..... *B65H 31/10* (2013.01); *B65H 31/14* (2013.01); *B65H 31/18* (2013.01); *B65H 43/06* (2013.01); *B65H 2403/46* (2013.01); *B65H 2601/26* (2013.01); *B65H 2801/06* (2013.01)

(58) Field of Classification Search

CPC ... B65H 1/08; B65H 1/10; B65H 1/12; B65H 1/14; B65H 1/16; B65H 1/24; B65H 31/04; B65H 31/08; B65H 31/10; B65H 31/12; B65H 31/14; B65H 31/16; B65H 31/18;

(Continued)

(56) References Cited

U.S. PATENT DOCUMENTS 5,305,996 A * 4/1994 Taniwa ..... B65H 1/12 271/126
6,736,393 B2 * 5/2004 Noh ..... B65H 31/10 271/214

(Continued)

FOREIGN PATENT DOCUMENTS

JP H10-218480 8/1998
JP 2000-169036 6/2000

(Continued)

*Primary Examiner* — Jeremy R Severson
(74) *Attorney, Agent, or Firm* — Kim & Stewart LLP

(57) ABSTRACT

According to one embodiment, a sheet post-processing apparatus has a sheet discharge tray, a drive motor, a power transmission breaker, a first power transmitter, a second power transmitter, and a load reducer. The sheet discharge tray stacks sheets. The drive motor raises and lowers the sheet discharge tray. The power transmission breaker can cut off power transmission from the drive motor to the sheet discharge tray when an upward external force is applied to the sheet discharge tray. The load reducer provides a reverse load to the sheet discharge tray in a reverse direction to the load generated on the sheet discharge tray due to stacking of the sheets. The load reducer is connected to the first power transmitter.

20 Claims, 13 Drawing Sheets

(58) Field of Classification Search
CPC ..... B65H 2403/944; B65H 2403/946; B65H 2601/26; B65H 2601/525; B65H 2601/27
USPC ..... 271/217, 219
See application file for complete search history.

(56) References Cited

U.S. PATENT DOCUMENTS

| | | | | |
|---|---|---|---|---|
| 8,186,677 | B2 * | 5/2012 | Motoi | B65H 31/10 271/213 |
| 9,802,780 | B2 * | 10/2017 | Kobayashi | B65H 31/04 |
| 10,183,819 | B2 * | 1/2019 | Phillips | B65H 1/14 |

FOREIGN PATENT DOCUMENTS

| | | |
|---|---|---|
| JP | 2000-247454 | 9/2000 |
| JP | 2004-099292 | 4/2004 |
| JP | 2011-026131 | 2/2011 |
| JP | 2013-124185 | 6/2013 |
| JP | 2014-084192 | 5/2014 |

* cited by examiner

SHEET POST-PROCESSING APPARATUS

CROSS-REFERENCE TO RELATED APPLICATION

This application claims priority from Japanese Patent Application No. 2017-120898 filed on Jun. 20, 2017, the contents of which are incorporated herein by reference in their entirety.

FIELD

Embodiments described herein relate generally to a sheet post-processing apparatus.

BACKGROUND

A sheet post-processing apparatus for performing post-processing on sheets conveyed from an image forming apparatus (for example, a multi-function peripheral (MFP)) is known. The sheet post-processing apparatus includes a processor for stapling or sorting the conveyed sheets. The sheet post-processing apparatus further includes a sheet discharge tray and a drive motor. The sheet discharge tray can stack sheets discharged from the processor. The drive motor raises and lowers the sheet discharge tray. The sheet discharge tray is driven to be raised and lowered in a state in which a large number of sheets are stacked (hereinafter also referred to as a "high load state"). The sheet discharge tray is required to be driven at a high speed in the high load state.

On the other hand, there is a mechanism that provides a reverse load to the sheet discharge tray in a reverse direction to the load generated on the sheet discharge tray.

For example, there is a mechanism that provides a reverse load to the sheet discharge tray by pulling the sheet discharge tray with a force-applying unit such as a tension spring. The reverse load serves as assistance for the drive motor.

On the other hand, when there is an obstacle below the sheet discharge tray, it is necessary to prevent the sheet discharge tray from being pinched by the obstacle.

However, in the mechanism described above, there is room for improvement in addition to achieving miniaturization of the drive motor and prevention of the sheet discharge tray from being pinched by an obstacle thereunder.

DETAILED DESCRIPTION

Figure 1:
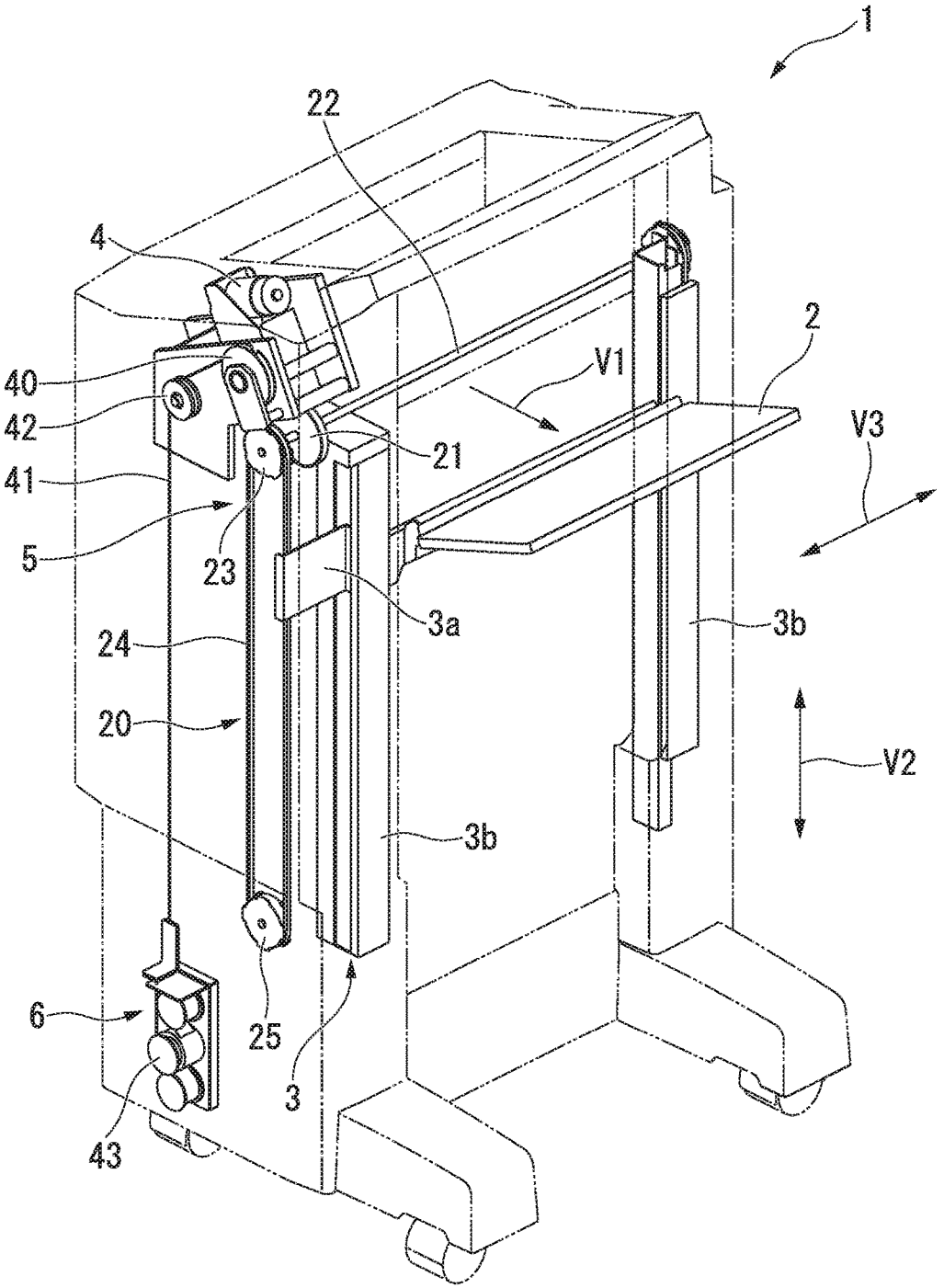
FIG. 1 is a perspective view showing a sheet post-processing apparatus according to an embodiment.

According to one embodiment, a sheet post-processing apparatus has a sheet discharge tray, a drive motor, a power transmission breaker, a first power transmitter, a second power transmitter, and a load reducer. The sheet discharge tray stacks sheets. The drive motor raises and lowers the sheet discharge tray. The power transmission breaker can cut off power transmission from the drive motor to the sheet discharge tray when an upward external force is applied to the sheet discharge tray. The first power transmitter transmits power from the drive motor to the power transmission breaker. The second power transmitter transmits power from the power transmission breaker to the sheet discharge tray. The load reducer provides a reverse load to the sheet discharge tray in a reverse direction to the load generated on the sheet discharge tray due to stacking of the sheets. The load reducer is connected to the first power transmitter.

Hereinafter, a sheet post-processing apparatus of an embodiment will be described with reference to the drawings. In each of the drawings, the same components are designated by the same reference characters.

A sheet post-processing apparatus 1 will be described.

FIG. 1 is a perspective view showing the sheet post-processing apparatus 1 according to the embodiment. In FIG. 1, an exterior of the sheet post-processing apparatus 1 is shown by a two-dot chain line.

As shown in FIG. 1, the sheet post-processing apparatus 1 includes a sheet discharge tray 2, a guide mechanism 3, a drive motor 4, a power transmitter 5, and a load reducing mechanism 6 (load reducer).

The sheet post-processing apparatus 1 is disposed adjacent to an image forming apparatus (not shown). A sheet is conveyed from the image forming apparatus to the sheet post-processing apparatus 1. The sheet post-processing apparatus 1 executes post-processing designated by a control panel (not shown) which receives a manipulation of a user for the conveyed sheet. For example, the sheet post-processing apparatus 1 performs staple processing and sort processing. For example, the sheet post-processing apparatus 1 performs a sheet folding process in which a sheet is folded in half and discharged.

The sheet discharge tray 2 will be described.

The sheet discharge tray 2 can stack discharged sheets. For example, sheets (a sheet bundle) on which the staple processing or the sort processing has been performed are discharged onto the sheet discharge tray 2 by a conveying belt (not shown). The sheet discharge tray 2 is raised and lowered using a rotational force of the drive motor 4. The sheet discharge tray 2 receives sheets being discharged. The sheet discharge tray 2 has a rectangular plate shape that longitudinally extends in a sheet width direction V3 perpendicular to a sheet discharge direction V1 and a vertical direction V2.

The guide mechanism 3 will be described.

The guide mechanism 3 can vertically guide the sheet discharge tray 2. The guide mechanism 3 includes a guide plate 3*a* and a guide rail 3*b*.

A pair of guide plates 3*a* is provided in the sheet width direction V3. The pair of guide plates 3*a* is attached to opposite ends of the sheet discharge tray 2. Each of the guide plates 3*a* extends outward in the sheet width direction from opposite ends of the sheet discharge tray 2 through a gap of the guide rail 3*b*. An extending end (outer end) of the guide plate 3*a* is connected to a timing belt 24.

A pair of the guide rails 3*b* is provided in the sheet width direction V3. The pair of the guide rails 3*b* is provided on opposite sides of the sheet discharge tray 2. The guide rails 3*b* longitudinally extend in the vertical direction. The guide rails 3*b* can guide the guide plates 3*a* in their longitudinal direction. That is, the sheet discharge tray 2 is guided along the guide rails 3*b* via the guide plates 3*a*.

The drive motor 4 will be described.

The drive motor 4 raises and lowers the sheet discharge tray 2. The drive motor 4 is a motor in which a rotation angle and a rotation speed can be controlled. For example, the drive motor 4 is a direct current (DC) motor. The sheet post-processing apparatus 1 includes a controller (not shown) which controls the rotation of the drive motor 4. For example, a drive circuit driven and controlled by the controller (not shown) is provided in the drive motor 4.

The power transmitter 5 will be described.

The power transmitter 5 can transmit power from the drive motor 4 to the sheet discharge tray 2.

Figure 2:
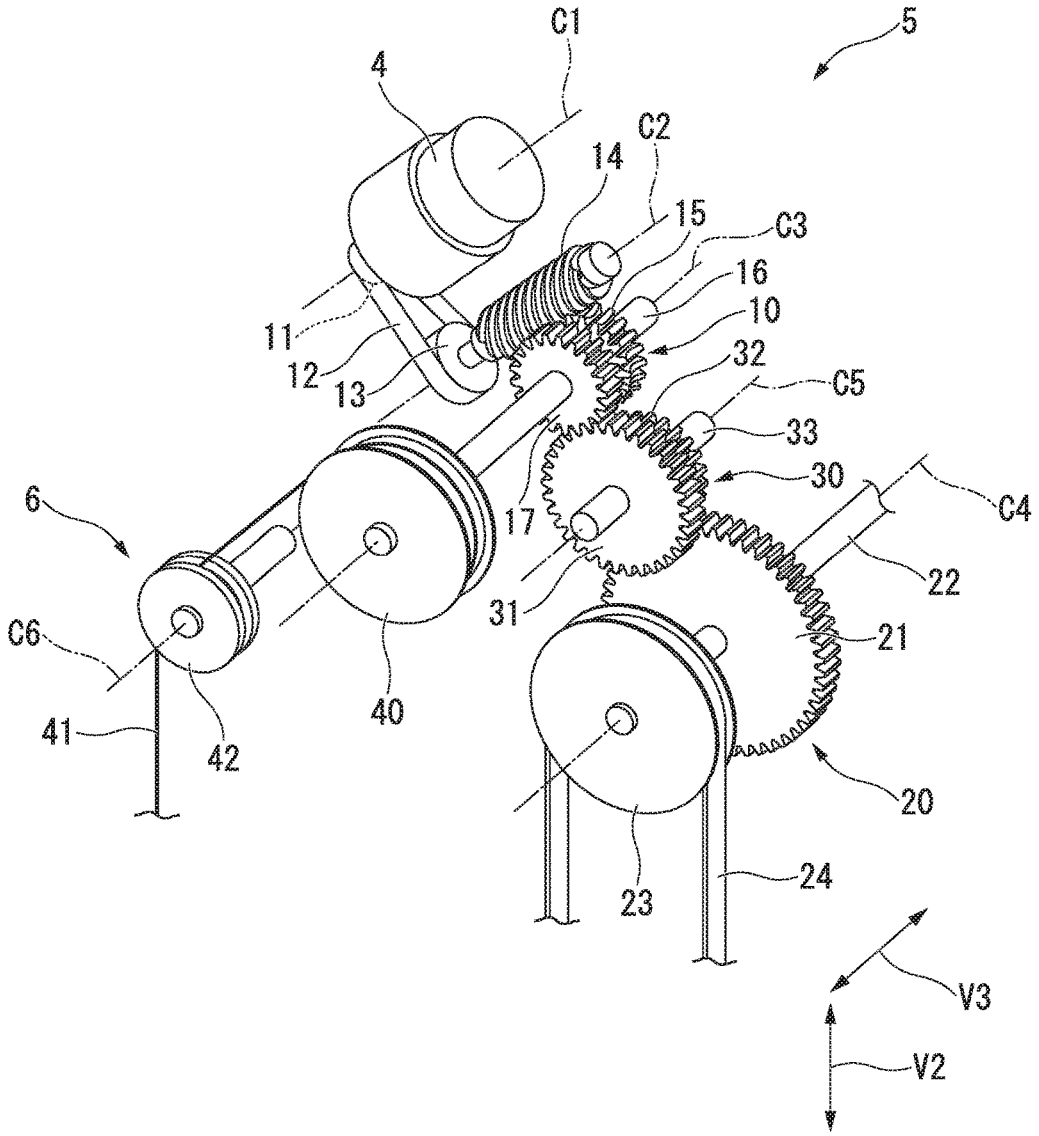
FIG. 2 is a perspective view showing a configuration of a power transmitter according to the embodiment.
Figure 3:
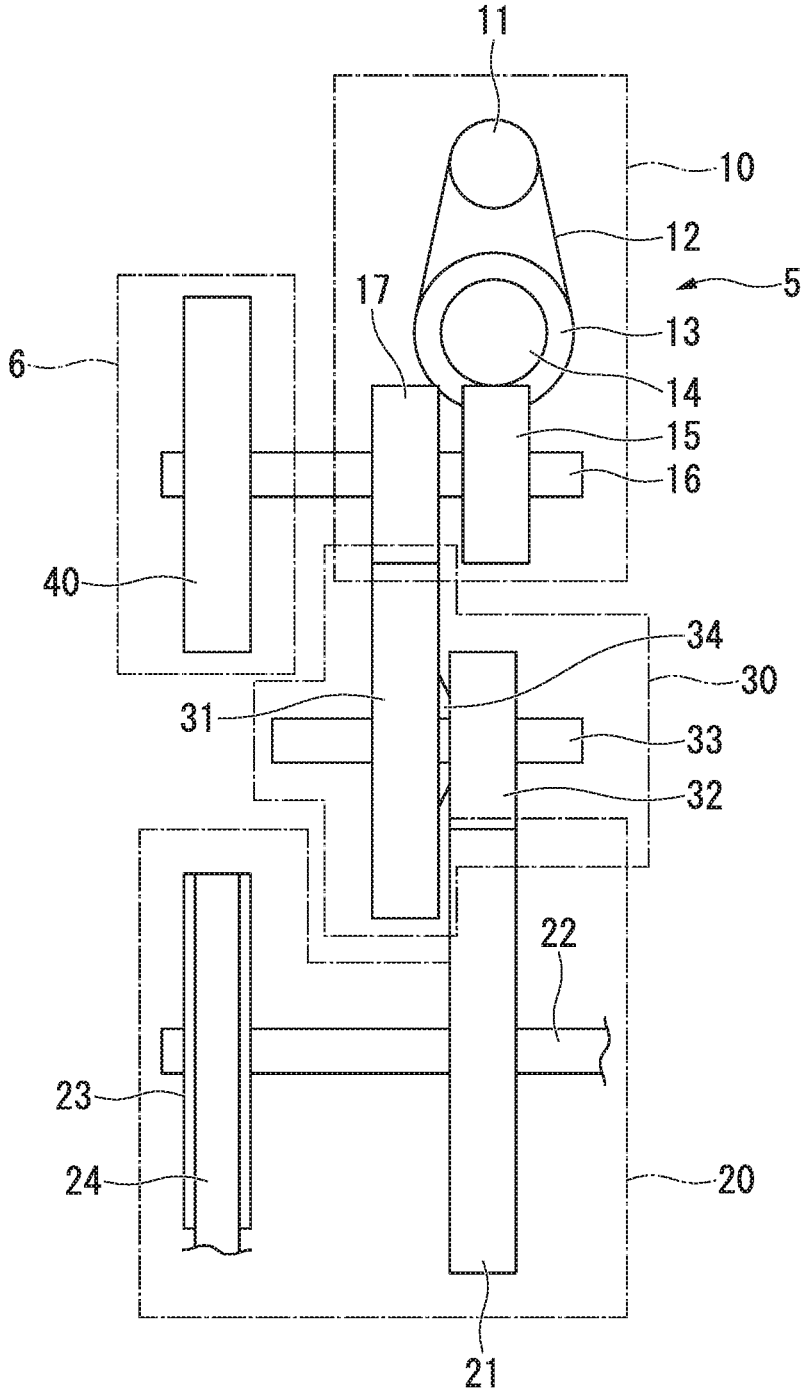
FIG. 3 is a plan view showing a configuration of the power transmitter according to the embodiment.

FIG. 2 is a perspective view showing a configuration of the power transmitter 5 according to the embodiment. FIG. 3 is a plan view showing a configuration of the power transmitter 5 according to the embodiment. In FIG. 2, the drive motor 4 is also shown.

As shown in FIG. 2, the power transmitter 5 includes a first power transmitter 10, a second power transmitter 20, and a power transmission cut-off mechanism 30 (power transmission breaker).

The first power transmitter 10 will be described.

The first power transmitter 10 transmits power from the drive motor 4 to the power transmission cut-off mechanism 30.

The first power transmitter 10 includes a motor pulley 11, a motor drive belt 12, a worm gear pulley 13, a worm gear 14, a worm wheel 15, a worm wheel shaft 16, and a gear 17. In FIG. 2, reference character C1 indicates an axis of a rotating shaft of the drive motor 4, reference character C2 indicates an axis of a shaft of the worm gear 14, and reference character C3 indicates an axis of the worm wheel shaft 16.

The motor pulley 11 is attached to the rotating shaft of the drive motor 4. The worm gear 14 has an axis C2 parallel to an axis C1 of the drive motor 4. The worm gear pulley 13 is attached to the shaft of the worm gear 14. The motor drive belt 12 is stretched between the motor pulley 11 and the worm gear pulley 13.

The worm gear 14 engages with the worm wheel 15. The worm wheel shaft 16 has a twisted positional relationship with the shaft of the worm gear 14. The worm wheel shaft 16 has an axis C3 in a direction perpendicular to the shaft of the worm gear 14. The worm wheel 15 and the gear 17 are attached to the worm wheel shaft 16. The gear 17 and the worm wheel 15 are coaxially disposed. The gear 17 and the worm wheel 15 are integrally rotatable. The gear 17 engages with a ratchet gear 31.

The first power transmitter 10 has a greater reduction gear ratio than the second power transmitter 20. For example, a reduction gear ratio of the first power transmitter 10 is approximately 50. Since the first power transmitter 10 has a greater reduction gear ratio than the second power transmitter 20, the following effects are achieved. It is possible to drive the sheet discharge tray 2 to be raised and lowered with a small driving force as compared with a case in which the first power transmitter 10 has a reduction gear ratio equal to or less than that of the second power transmitter 20. Therefore, even when the sheet discharge tray 2 is in a high load state in which a large number of sheets are stacked, the sheet discharge tray 2 can be driven by a compact drive motor 4.

The second power transmitter 20 will be described.

The second power transmitter 20 transmits power from the power transmission cut-off mechanism 30 to the sheet discharge tray 2 (see FIG. 1). As shown in FIG. 1, the second power transmitter 20 includes a main shaft gear 21, a tray drive shaft 22, a timing pulley 23, the timing belt 24, and a timing idler 25. In FIG. 2, reference character C4 indicates an axis of the tray drive shaft 22.

As shown in FIG. 2, the main shaft gear 21 and the timing pulley 23 are attached to the tray drive shaft 22. The tray drive shaft 22 has an axis C4 in a direction parallel to the worm wheel shaft 16. The main shaft gear 21 and the timing pulley 23 are coaxially disposed. The main shaft gear 21 and the timing pulley 23 are integrally rotatable. As shown in FIG. 1, the timing belt 24 is stretched between the timing pulley 23 and the timing idler 25.

The second power transmitter 20 has a reduction gear ratio smaller than that of the first power transmitter 10. For example, a reduction gear ratio of the second power transmitter 20 is approximately 5. Since the second power transmitter 20 has a smaller reduction gear ratio than the first power transmitter 10, the following effects are achieved. It is easy to drive backward (rotate in reverse) when an upward external force is applied to the sheet discharge tray 2 as compared with a case in which the second power transmitter 20 has a reduction gear ratio equal to or greater than that of the first power transmitter 10. That is, an external force applied to the sheet discharge tray 2 is easily transmitted to the power transmission cut-off mechanism 30. Therefore, it is possible to prevent the sheet discharge tray 2 from being pinched by an obstacle thereunder.

The power transmission cut-off mechanism 30 will be described.

As shown in FIG. 2, the power transmission cut-off mechanism 30 is disposed between the first power transmitter 10 and the second power transmitter 20. When an upward external force is applied to the sheet discharge tray 2 (see FIG. 1), the power transmission cut-off mechanism 30 cuts off power transmission from the drive motor 4 to the sheet discharge tray 2.

Here, the "upward external force" applied to the sheet discharge tray 2 means an external force equal to or more than a threshold value. The threshold value is a force that can pull apart a force-applying member (not shown) against an applying force of the force-applying member when an upward external force is applied to the sheet discharge tray 2. For example, the upward external force includes an impact force when the sheet discharge tray 2 hits an obstacle thereunder in a case in which the drive motor 4 lowers the sheet discharge tray 2. When an upward external force is not applied to the sheet discharge tray 2, the power transmission cut-off mechanism 30 allows power to be transmitted from the drive motor 4 to the sheet discharge tray 2.

The power transmission cut-off mechanism 30 includes the ratchet gear 31, an idler gear 32, and a pinch prevention mechanism shaft 33. In FIG. 2, reference character C5 indicates an axis of the pinch prevention mechanism shaft 33.

The ratchet gear 31 and the idler gear 32 are attached to the pinch prevention mechanism shaft 33. The pinch prevention mechanism shaft 33 has an axis C5 in a direction parallel to the worm wheel shaft 16. The ratchet gear 31 and the idler gear 32 are coaxially disposed. As shown in FIG. 3, the ratchet gear 31 and the idler gear 32 are integrally rotatable by a coupler 34. The idler gear 32 engages with the main shaft gear 21.

The ratchet gear 31 restricts downward movement of the sheet discharge tray 2 when an upward external force is applied to the sheet discharge tray 2. The ratchet gear 31 may cause the sheet discharge tray 2 to stop at its regular position when an upward external force is applied to the sheet discharge tray 2. The ratchet gear 31 may allow upward movement of the sheet discharge tray 2 when an upward external force is applied to the sheet discharge tray 2.

For example, a force is applied to the ratchet gear 31 to be directed to the idler gear 32 by a force-applying member (not shown). When an upward external force is applied to the sheet discharge tray 2, the ratchet gear 31 is movable in a direction away from the idler gear 32 in an axial direction of the pinch prevention mechanism shaft 33 against an applying force of the force-applying member by action of the coupler 34. When an upward external force is applied to the sheet discharge tray 2 in a state in which power of the drive motor 4 is transmitted, the ratchet gear 31 pushes back the force-applying member and remains idle. When an upward external force is applied to the sheet discharge tray 2 in a state in which power of the drive motor 4 is transmitted, the idler gear 32 is released from the coupling with the ratchet gear 31 by the action of the coupler 34. That is, when the ratchet gear 31 remains idle, the idler gear 32 is in a power cut-off state.

Hereinafter, the state in which the idler gear 32 is coupled with the ratchet gear 31 is also referred to as a "power transmission state", and the state in which the coupling between the idler gear 32 and the ratchet gear 31 is released is also referred to as a "power cut-off state".

Power transmission of the drive motor 4 will be described with reference to FIG. 2.

As shown in FIG. 2, rotational power of the drive motor 4 is transmitted to the worm gear 14 via the motor pulley 11, the motor drive belt 12, and the worm gear pulley 13. The power of the worm gear 14 is transmitted to the worm wheel 15. The worm wheel 15 rotates in conjunction with the rotation of the worm gear 14. The gear 17 integrally rotates with the worm wheel 15.

In the power transmission state, the ratchet gear 31 rotates following the rotation of the gear 17.

The idler gear 32 integrally rotates with the ratchet gear 31. The main shaft gear 21 rotates following the rotation of the ratchet gear 31. The timing pulley 23 integrally rotates with the main shaft gear 21. The timing belt 24 rotates (moves vertically) following the rotation of the timing pulley 23. The guide plate 3*a* is raised and lowered following the rotation (vertical movement) of the timing belt 24. The sheet discharge tray 2 is raised and lowered integrally with the guide plate 3*a*. For example, when the drive motor 4 rotates in a forward direction, the sheet discharge tray 2 is raised. On the other hand, when the drive motor 4 rotates in a reverse direction, the sheet discharge tray 2 is lowered.

In the power cut-off state, the ratchet gear 31 cuts off the power transmission from the drive motor 4 to the sheet discharge tray 2. In the power cut-off state, the ratchet gear 31 remains idle.

The load reducing mechanism 6 will be described.

The load reducing mechanism 6 provides a reverse load to the sheet discharge tray 2 in a reverse direction to the load generated on the sheet discharge tray 2 due to stacking of the sheets. A load acting downward in a vertical direction such as a weight of the sheet bundle acts on the sheet discharge tray 2. The load generated on the sheet discharge tray 2 is a load acting downward with respect to the sheet discharge tray 2. The reverse load is a load acting upward with respect to the sheet discharge tray 2.

As shown in FIG. 1, the load reducing mechanism 6 is disposed on an outer side of the sheet discharge tray 2 in the sheet width direction V3. The load reducing mechanism 6 includes a wire pulley 40, a wire 41, a wire idler 42, and a constant load spring 43. In FIG. 2, reference character C6 indicates an axis of a shaft of the wire idler 42.

As shown in FIG. 2, the wire pulley 40 is attached to one end of the worm wheel shaft 16.

One end (upper end) of the wire 41 is attached to the wire pulley 40. As shown in FIG. 1, the other end (lower end) of the wire 41 is attached to the constant load spring 43. When the sheet discharge tray 2 moves downward, the wire 41 is wound around the wire pulley 40.

The wire idler 42 has an axis C6 in a direction parallel to the worm wheel shaft 16. The wire idler 42 movably supports the wire 41. The wire idler 42 allows the wire 41 to move vertically.

The wire idler 42 is disposed on a side opposite to the guide mechanism 3 via the wire pulley 40. Since the wire idler 42 is disposed on the side opposite to the guide mechanism 3 via the wire pulley 40, it is possible to prevent the constant load spring 43 and the wire 41 from interfering with the guide mechanism 3.

The constant load spring 43 provides a reverse load to the sheet discharge tray 2. For example, the constant load spring 43 is a long leaf spring bent at a constant curvature. The constant load spring 43 has a constant load regardless of displacement. The constant load spring 43 provides a constant reverse load to the sheet discharge tray 2 regardless of magnitude of the load generated on the sheet discharge tray 2. That is, the constant load spring 43 provides a constant reverse load to the sheet discharge tray 2 regardless of a vertical position of the sheet discharge tray 2. In other words, the constant load spring 43 provides a constant reverse load to the sheet discharge tray 2 regardless of a winding amount of the wire 41.

As shown in FIG. 3, the load reducing mechanism 6 is connected to the first power transmitter 10. The load reducing mechanism 6 is connected to the power transmission cut-off mechanism 30 side (a side opposite to the drive motor 4 shown in FIG. 2) in the first power transmitter 10. Specifically, the wire pulley 40 of the load reducing mechanism 6 is connected to the worm wheel shaft 16 of the first power transmitter 10.

Drive control of the drive motor 4 will be described with reference to FIG. 1.

As shown in FIG. 1, the drive motor 4 raises and lowers the sheet discharge tray 2 so that a position of the sheet (the uppermost sheet) on the sheet discharge tray 2 becomes a predetermined height. Hereinafter, a position of the sheet (the uppermost sheet) on the sheet discharge tray 2 is also referred to as a "sheet position". A sheet position detection sensor (not shown) that detects the sheet position is provided in the sheet post-processing apparatus 1. The drive motor 4 raises and lowers the sheet discharge tray 2 so that a position of the sheet reaches a predetermined height according to a detection result of the sheet position detection sensor.

A relationship between the load generated on the sheet discharge tray 2 and the position of the sheet discharge tray 2 will be described with reference to FIGS. 4 and 5.

Figure 4:
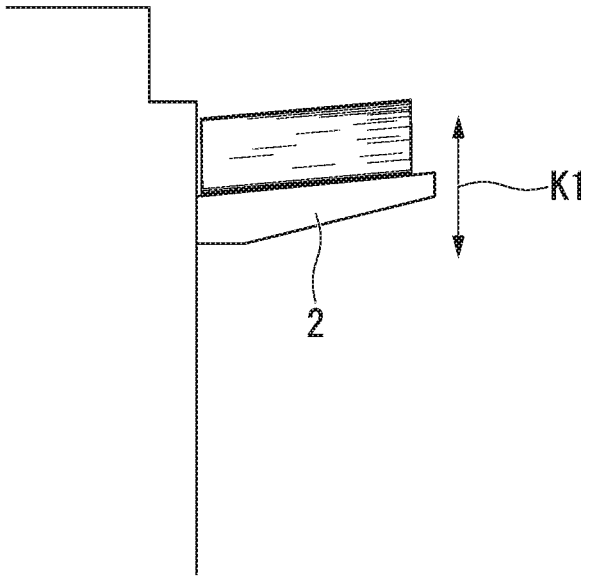
FIG. 4 is a view showing a relationship between a load generated in a sheet discharge tray and a position of the sheet discharge tray according to the embodiment.
Figure 5:
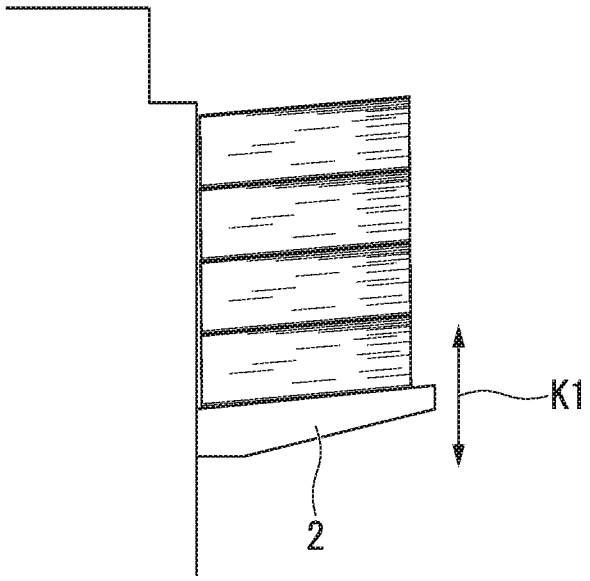
FIG. 5 is a view showing a relationship between a load generated in the sheet discharge tray and a position of the sheet discharge tray according to the embodiment.

FIGS. 4 and 5 are views showing a relationship between the load generated on the sheet discharge tray 2 and the position of the sheet discharge tray 2 according to the embodiment. FIG. 4 shows a low load state in which a small number of sheets are stacked on the sheet discharge tray 2. FIG. 5 shows a high load state in which a large number of sheets are stacked on the sheet discharge tray 2. The load generated on the sheet discharge tray 2 is the total weight of the sheet bundle stacked on the sheet discharge tray 2. Hereinafter, the load generated on the sheet discharge tray 2 is also referred to as a "tray load", and the vertical position of the sheet discharge tray 2 is also referred to as a "tray position".

As shown in FIG. 4, discharged sheets are stacked on the sheet discharge tray 2. As shown in FIG. 5, the tray position in the high load state is lower than the tray position in the low load state. As the number of sheets stacked on the sheet discharge tray 2 increases, the sheet discharge tray 2 moves downward.

The number of sheets stacked on the sheet discharge tray 2 (the total weight of the sheet bundle) and the tray position are in a proportional relationship. The sheet discharge tray 2 on which the sheets are stacked is lowered so that a sheet discharge path is not blocked by the sheets.

The sheet discharge tray 2 operates up and down while supporting the total weight of the sheet bundle. The sheet discharge tray 2 can vibrate up and down by forward and backward rotation of the drive motor 4 (see FIG. 1). In FIGS. 4 and 5, reference character K1 indicates a direction of vibration of the sheet discharge tray 2.

Since the sheet discharge tray 2 vibrates up and down, the following effects are achieved. It is possible to prevent one end of a discharged sheet (the uppermost sheet) from remaining on a sheet discharge guide (not shown) in front of the sheet discharge tray 2. That is, the discharged sheet can be stacked on the sheet discharge tray 2 or on a sheet bundle on the sheet discharge tray 2 in an orderly manner. Therefore, it is possible to avoid a jam caused by a sheet remaining on the sheet discharge guide.

Due to the load reducing mechanism 6, a constant reverse load is provided to the sheet discharge tray 2. Hereinafter, the number of sheets stacked on the sheet discharge tray 2 is also referred to as a "number of stacked sheets".

For example, when the number of stacked sheets is less than a threshold number of sheets, since the reverse load is greater than the tray load, the drive motor 4 outputs a torque to reverse the reverse load. That is, the drive motor 4 stops raising of the sheet discharge tray 2 at a predetermined height.

For example, when the number of stacked sheets is equal to the threshold number of sheets, since the tray load and the reverse load are balanced, rotation of the drive motor 4 is stopped.

For example, when the number of stacked sheets exceeds the threshold number of sheets, since the tray load is greater than the reverse load, the drive motor 4 outputs a torque to reverse the tray load. That is, the drive motor 4 stops lowering of the sheet discharge tray 2 at a predetermined height.

Effects of the load reducing mechanism 6 according to the embodiment will be described with reference to FIGS. 6 and 7.

Figure 6:
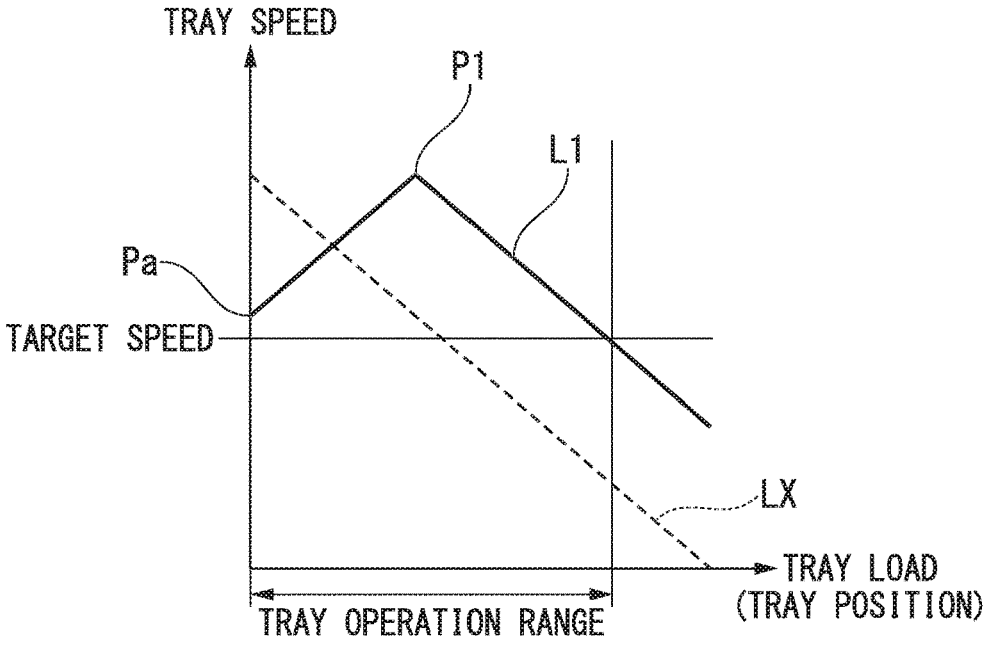
FIG. 6 is a view for describing an effect of a load reducing mechanism according to the embodiment.
Figure 7:
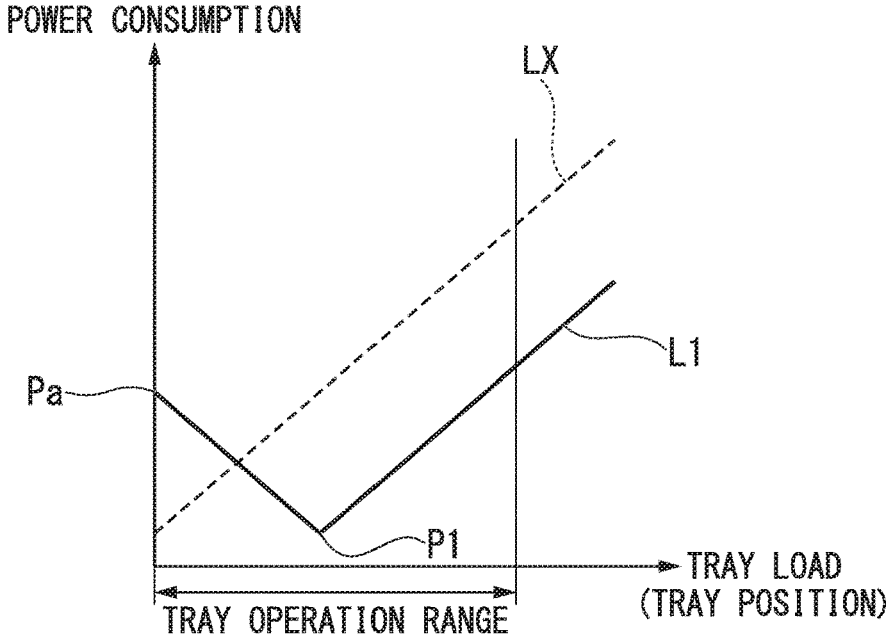
FIG. 7 is a view for describing an effect of the load reducing mechanism according to the embodiment.

FIGS. 6 and 7 are views for describing effects of the load reducing mechanism 6 according to the embodiment.

In FIG. 6, the horizontal axis represents the tray load (tray position) and the vertical axis represents a raising/lowering speed of the sheet discharge tray 2 (hereinafter also referred to as a "tray speed"). In FIG. 7, the horizontal axis represents the tray load (tray position) and the vertical axis represents power consumption. In FIGS. 6 and 7, a solid line L1 indicates a case in which the load reducing mechanism 6 is provided (the embodiment), and a broken line LX indicates a case in which the load reducing mechanism 6 is not provided (hereinafter also referred to as a "comparative example"). The tray speed in FIG. 6 is an average value assuming the raising/lowering motion of the sheet discharge tray 2.

As shown in FIG. 6, in the case of the comparative example (see the broken line LX), as the tray load grows higher, the tray speed becomes lower. In the case of the comparative example, there is a possibility that the sheet discharge tray 2 cannot be operated at a target speed in a high load state.

On the other hand, in the case of the embodiment (see the solid line L1), the tray speed becomes higher as the tray load grows higher from a starting point Pa, and then becomes lower as the tray load grows higher after passing through a turning point P1.

For example, the starting point Pa is a state in which there is no tray load. As sheets are stacked on the sheet discharge tray 2 and when a predetermined number of sheets are accumulated, the tray load and the reverse load cancel each other out (the turning point P1). In the present embodiment, the relationship between the tray load and the tray speed moves to the high load side parallel to the comparative example.

According to the embodiment, it is possible to operate the sheet discharge tray 2 at the target speed in the high load state. For example, even when a tray operation range is set up to the high load state as shown in FIG. 6, the sheet discharge tray 2 can be operated at the target speed over the entire tray operation range.

The graph of FIG. 7 shows an inverted relationship with the graph of FIG. 6.

Specifically, as shown in FIG. 7, in the case of the comparative example (see the broken line LX), power consumption increases as the tray load increases.

On the other hand, in the case of the embodiment (see the solid line L1), the power consumption decreases as the tray load increases from the starting point Pa, and increases as the tray load increases after passing through the turning point P1. In the embodiment, the relationship between the tray load and the power consumption moves to the high load side parallel to the comparative example.

In FIGS. 6 and 7, the turning point P1 is a point at which the tray load and the reverse load are balanced.

According to the embodiment, it is possible to reduce the power consumption in the high load state. For example, even when the tray operation range is set up to the high load state as shown in FIG. 7, power consumption can be reduced over the entire tray operation range.

According to the embodiment, the sheet post-processing apparatus 1 includes the sheet discharge tray 2, the drive motor 4, the power transmission cut-off mechanism 30, the first power transmitter 10, the second power transmitter 20, and the load reducing mechanism 6. The sheet discharge tray 2 can stack sheets. The drive motor 4 raises and lowers the sheet discharge tray 2. When an upward external force is applied to the sheet discharge tray 2, the power transmission cut-off mechanism 30 can cut off power transmission from the drive motor 4 to the sheet discharge tray 2. The first power transmitter 10 transmits power from the drive motor 4 to the power transmission cut-off mechanism 30. The second power transmitter 20 transmits power from the power transmission cut-off mechanism 30 to the sheet discharge tray 2. The load reducing mechanism 6 provides the reverse load to the sheet discharge tray 2 in the reverse direction to the load generated on the sheet discharge tray 2 due to the stacking of the sheets. The load reducing mechanism 6 is connected to the first power transmitter 10. With the configuration above, the following effects are achieved. The raising/lowering drive of the sheet discharge tray 2 requires a low output since the reverse load in the reverse direction with respect to the tray load is provided to the sheet discharge tray 2, and thus it is possible to reduce a size of the drive motor 4. In addition, since power transmission from the drive motor 4 to the sheet discharge tray 2 is cut off when an upward external force is applied to the sheet discharge tray 2, it is possible to prevent the sheet discharge tray 2 from being pinched by an obstacle thereunder. Therefore, it is possible to prevent the sheet discharge tray 2 from being pinched by an obstacle thereunder while reducing the size of the drive motor 4.

According to the embodiment, the sheet post-processing apparatus 1 includes the sheet discharge tray 2, the drive motor 4, the power transmitter 5, and the load reducing mechanism 6. The sheet discharge tray 2 can stack sheets. The drive motor 4 raises and lowers the sheet discharge tray 2. The power transmitter 5 can transmit power from the drive motor 4 to the sheet discharge tray 2. The load reducing mechanism 6 provides the reverse load to the sheet discharge tray 2 in the reverse direction to the load generated on the sheet discharge tray 2 due to the stacking of the sheets. The power transmitter 5 includes the first power transmitter 10 and the second power transmitter 20. The second power transmitter 20 has a reduction gear ratio lower than that of the first power transmitter 10. The load reducing mechanism 6 is connected to the first power transmitter 10.

With the configuration above, the following effects are achieved. It is possible to drive the sheet discharge tray 2 to be raised and lowered with a small driving force as compared with a case in which the first power transmitter 10 has a reduction gear ratio equal to or less than that of the second power transmitter 20. Therefore, even when the sheet discharge tray 2 is in the high load state, the sheet discharge tray 2 can be driven by the compact drive motor 4. In addition, backward drive (reverse rotation) may easily occur when an upward external force is applied to the sheet discharge tray 2 as compared with a case in which the second power transmitter 20 has a reduction gear ratio equal to or greater than that of the first power transmitter 10. That is, an external force applied to the sheet discharge tray 2 is easily transmitted to the power transmission cut-off mechanism 30. Therefore, it is possible to prevent the sheet discharge tray 2 from being pinched by an obstacle thereunder. Therefore, it is possible to prevent the sheet discharge tray 2 from being pinched by an obstacle thereunder while reducing the size of the drive motor 4.

In addition, when an upward external force is applied to the sheet discharge tray 2, the power transmission cut-off mechanism 30 achieves the following effects by including the ratchet gear 31 which restricts downward movement of the sheet discharge tray 2. When there is an obstacle below the sheet discharge tray 2, a countermeasure is required to prevent the sheet discharge tray 2 from being lowered. As the countermeasure against the lowering of the sheet discharge tray 2, there is a mechanism that stops the drive motor 4 (hereinafter also referred to as a "stop mechanism") by detecting a reverse torque or the tray position. Also, there is a mechanism that cuts off the power transmission (hereinafter also referred to as "cut-off mechanism by torque") from the drive motor 4 to the sheet discharge tray 2 by the reverse torque. However, in detecting the tray position, there is a possibility that an obstacle will go undetected in a case in which the obstacle positioned under the sheet discharge tray 2 is deformable. On the other hand, in the cut-off mechanism or the stop mechanism by a torque, when a reverse load is directly applied to the sheet discharge tray 2, there is a possibility that an influence of the obstacle will not be sufficiently received and thus the power transmission cut-off function or the drive motor stop function will not work. According to the embodiment, when an upward external force is applied to the sheet discharge tray 2, the downward movement of the sheet discharge tray 2 is restricted due to the ratchet gear 31. In addition, since the load reducing mechanism 6 is connected to the first power transmitter 10 and is not configured to directly apply a reverse load to the sheet discharge tray 2, the power transmission cut-off mechanism 30 can be sufficiently affected by an obstacle. Therefore, it is possible to more effectively prevent the sheet discharge tray 2 from being pinched by an obstacle thereunder.

Also, the first power transmitter 10 includes the worm gear 14, the worm wheel 15, the worm wheel shaft 16, and the gear 17. The worm gear 14 is rotationally driven by the drive motor 4. The worm gear 14 engages with the worm wheel 15. The worm wheel 15 is attached to the worm wheel shaft 16. The worm wheel shaft 16 has a twisted positional relationship with the shaft of the worm gear 14. The gear 17 is attached to the worm wheel shaft 16. The gear 17 is connected to the power transmission cut-off mechanism 30. With the configuration above, the following effects are achieved. Since the first power transmitter 10 is constituted by a combination of a plurality of gears, the device configuration can be simplified. In addition, since a self-locking function of the worm gear 14 can be utilized, it is possible to prevent the drive motor 4 from rotating due to the reverse load.

Also, since the load reducing mechanism 6 is connected to the worm wheel shaft 16, the following effects are achieved. As a connection mode of the load reducing mechanism 6, a configuration in which the load reducing mechanism 6 is connected to the drive motor 4 side or the second power transmitter 20 than to the worm gear 14 is conceivable. However, when the load reducing mechanism 6 is connected to the drive motor 4 than to the worm gear 14, since the self-locking by the worm gear 14 does not function, there is a possibility that the drive motor 4 will be rotated by the reverse load. In addition, when the load reducing mechanism 6 is connected to the drive motor 4 than to the worm gear 14, there is a possibility that direct transmission of the rotational force of the drive motor 4 to the load reducing mechanism 6 will become excessive. On the other hand, when the load reducing mechanism 6 is connected to the second power transmitter 20, there is a possibility that it will not be possible to determine whether a load is caused by the sheet discharge tray 2 hitting an obstacle or a reverse load by the load reducing mechanism 6. According to the embodiment, since the load reducing mechanism 6 is connected to the worm wheel shaft 16 and the self-locking by the worm gear 14 functions, the drive motor 4 is not rotated by the reverse load. In addition, since the load reducing mechanism 6 is separated from the drive motor 4, direct transmission of the rotational force of the drive motor 4 to the load reducing mechanism 6 does not become excessive. In addition, since the load reducing mechanism 6 is separated from the second power transmitter 20, it is possible to determine whether a load is caused by the sheet discharge tray 2 hitting an obstacle or the reverse load by the load reducing mechanism 6.

Also, since the load reducing mechanism 6 includes the constant load spring 43 which provides a constant reverse load to the sheet discharge tray 2 regardless of the magnitude of the load generated on the sheet discharge tray 2, the following effects are achieved. It is possible to reduce the power consumption while operating the sheet discharge tray 2 at the target speed by changing a set load (reverse load) of the constant load spring 43 in accordance with the number of stacked sheets frequently used by a user.

A modified example of the embodiment will be described.

First, a first modified example of the embodiment will be described with reference to FIGS. 8 to 12.

Figure 8:
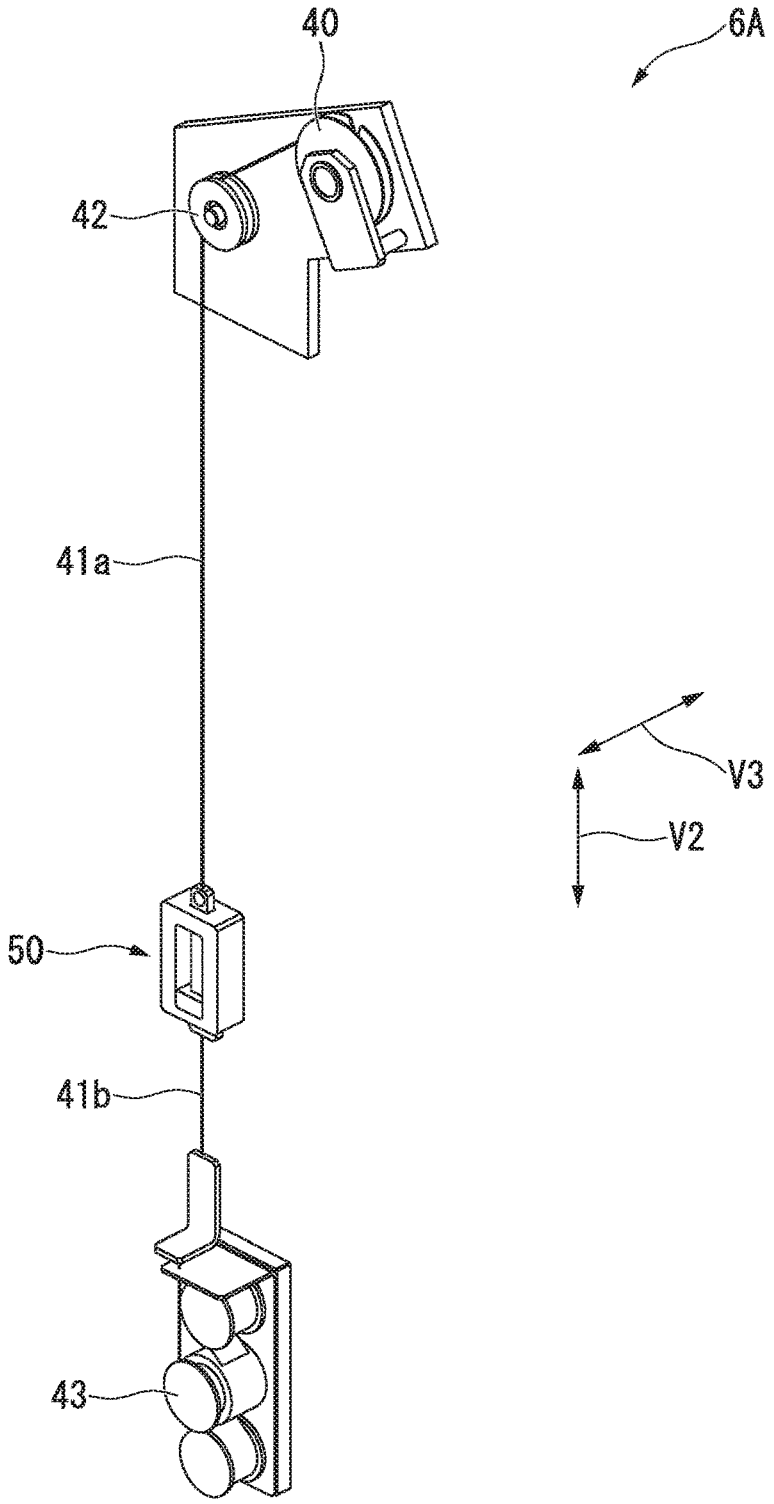
FIG. 8 is a perspective view showing a configuration of a load reducing mechanism according to a first modified example of the embodiment.

FIG. 8 is a perspective view showing a configuration of a load reducing mechanism 6A according to the first modified example of the embodiment.

As shown in FIG. 8, the load reducing mechanism 6A may further include a switching mechanism 50 (switcher) capable of switching between a reverse load non-transmission state and a reverse load transmission state. Here, the reverse load non-transmission state is a state in which the reverse load is not transmitted to the sheet discharge tray 2. The reverse load transmission state is a state in which the reverse load is transmitted to the sheet discharge tray 2.

The switching mechanism 50 is attached to a pair of wires 41*a* and 41*b* between upper and lower portions of the wire idler 42 and the constant load spring 43 in the load reducing mechanism 6A.

In the first modified example, the pair of wires 41*a* and 41*b* are the first wire 41*a* and the second wire 41*b*.

One end (upper end) of the first wire 41*a* is attached to the wire pulley 40. The other end (lower end) of the first wire 41*a* is attached to the switching mechanism 50.

One end (upper end) of the second wire 41*b* is attached to the switching mechanism 50. The other end (lower end) of the second wire 41*b* is attached to the constant load spring 43.

Figure 9A:
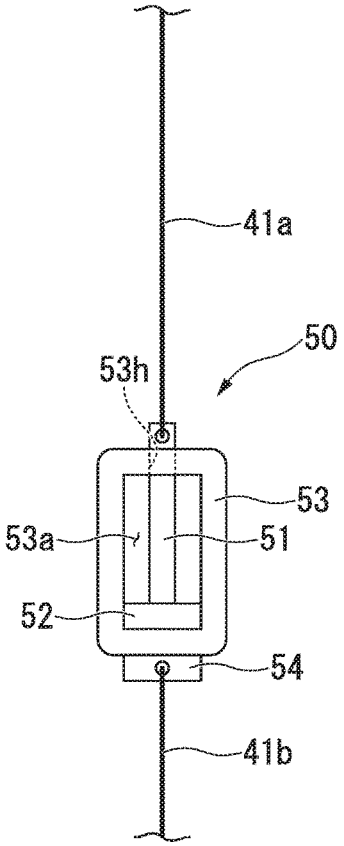
FIG. 9A is a front view showing a configuration of a switching mechanism according to the first modified example of the embodiment.

FIG. 9A is a front view showing a configuration of the switching mechanism 50 according to the first modified example of the embodiment.

As shown in FIG. 9A, the switching mechanism 50 includes a switching bar 51, a switching stopper 52, and a switching base 53.

The switching bar 51 moves integrally with the first wire 41*a*. The switching bar 51 is a rod-shaped member that longitudinally extends in a vertical direction. A lower end of the first wire 41*a* is attached to an upper end of the switching bar 51.

The switching stopper 52 moves integrally with the switching bar 51. The switching stopper 52 is disposed to be able to move in an inner space 53*a* of the switching base 53 vertically. The switching stopper 52 is a plate-shaped member that longitudinally extends in a direction perpendicular to a longitudinal direction of the switching bar 51. The switching stopper 52 is attached to a lower end of the switching bar 51. A combined body of the switching bar 51 and the switching stopper 52 has an inverted T shape.

The switching base 53 is a rectangular frame-shaped member that longitudinally extends in the vertical direction. The switching base 53 is supported at a regular position by a supporting member (not shown). The inner space 53*a* of the switching base 53 has a size that allows the switching stopper 52 to move vertically. A through hole 53*h* that opens vertically is formed at an upper end of the switching base 53. The through hole 53*h* has a size that allows the switching bar 51 to move vertically. A second wire connector 54 to which an upper end of the second wire 41*b* is attached is provided at a lower end of the switching base 53.

An operation of the switching mechanism 50 will be described.

Figure 9B:
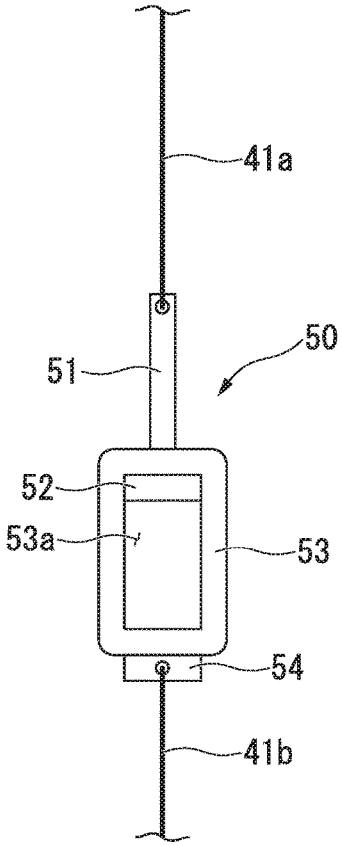
FIG. 9B is a view for describing an operation of the switching mechanism of the first modified example of the embodiment.
Figure 9C:
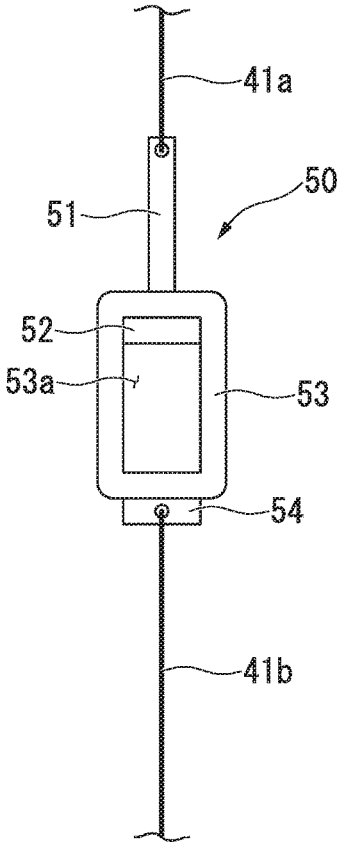
FIG. 9C is a view for describing an operation of the switching mechanism of the first modified example of the embodiment.

FIGS. 9B and 9C are views for describing the operation of the switching mechanism 50 according to the first modified example of the embodiment.

Hereinafter, a state in which the sheet discharge tray 2 (see FIG. 1) is positioned on the upper side and a sheet bundle is not stacked on the sheet discharge tray 2 is also referred to as a "state without a tray load". In the state without a tray load, the switching stopper 52 is in contact with an inner lower surface of the switching base 53 as shown in FIG. 9A.

In addition, in the state without a tray load, most of the switching bar 51 is accommodated in the inner space 53*a* of the switching base 53.

When the sheet discharge tray 2 is moved downward from the state without a tray load, the switching base 53 does not move at the beginning. That is, in the initial stage of moving the sheet discharge tray 2 downward, only the switching bar 51 and the switching stopper 52 move upward. When the sheet discharge tray 2 is continuously moved downward, the switching stopper 52 comes into contact with an inner upper surface of the switching base 53 as shown in FIG. 9B.

When the sheet discharge tray 2 is moved further downward from the state in which the switching stopper 52 is in contact with the inner upper surface of the switching base 53, the switching base 53 moves upward together with the switching stopper 52 as shown in FIG. 9C. When the switching base 53 moves upward, a reverse load due to the constant load spring 43 is transmitted to the sheet discharge tray 2.

An effect of the load reducing mechanism 6A according to the first modified example of the embodiment will be described with reference to FIGS. 10 to 12.

Figure 10:
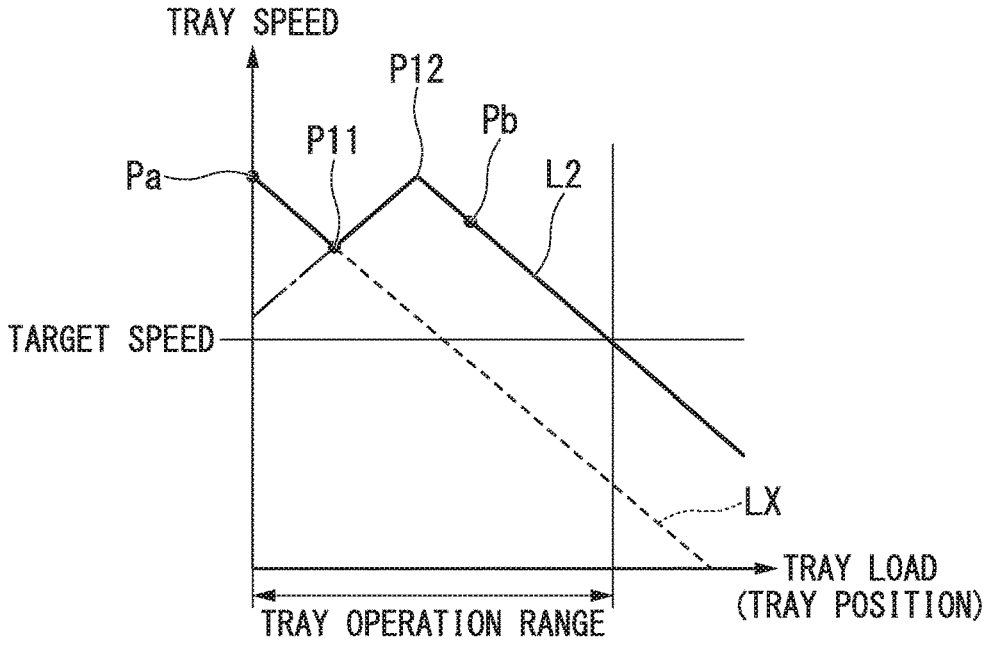
FIG. 10 is a view for describing an effect of the load reducing mechanism according to the first modified example of the embodiment.
Figure 11:
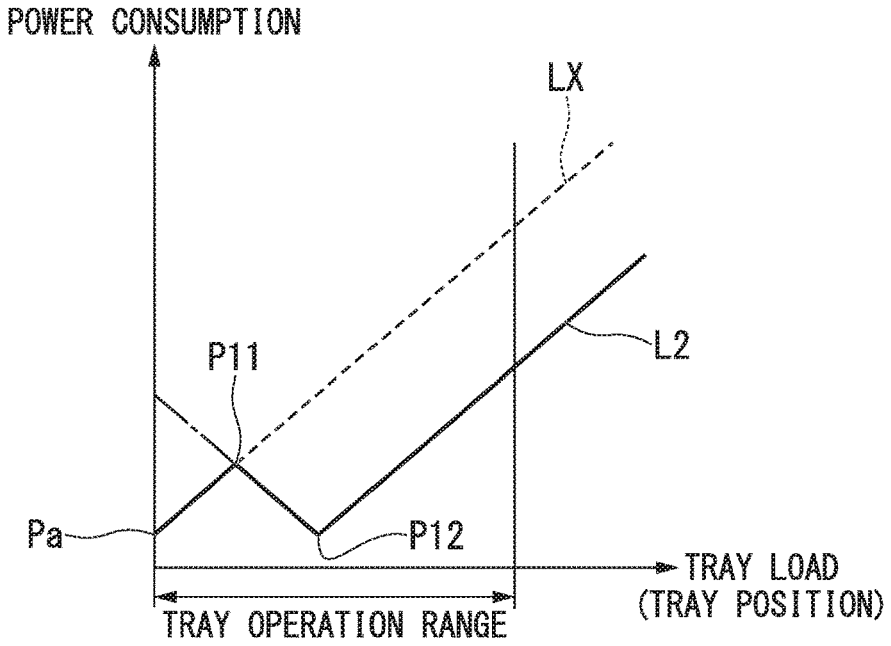
FIG. 11 is a view for describing an effect of the load reducing mechanism according to the first modified example of the embodiment.
Figure 12:
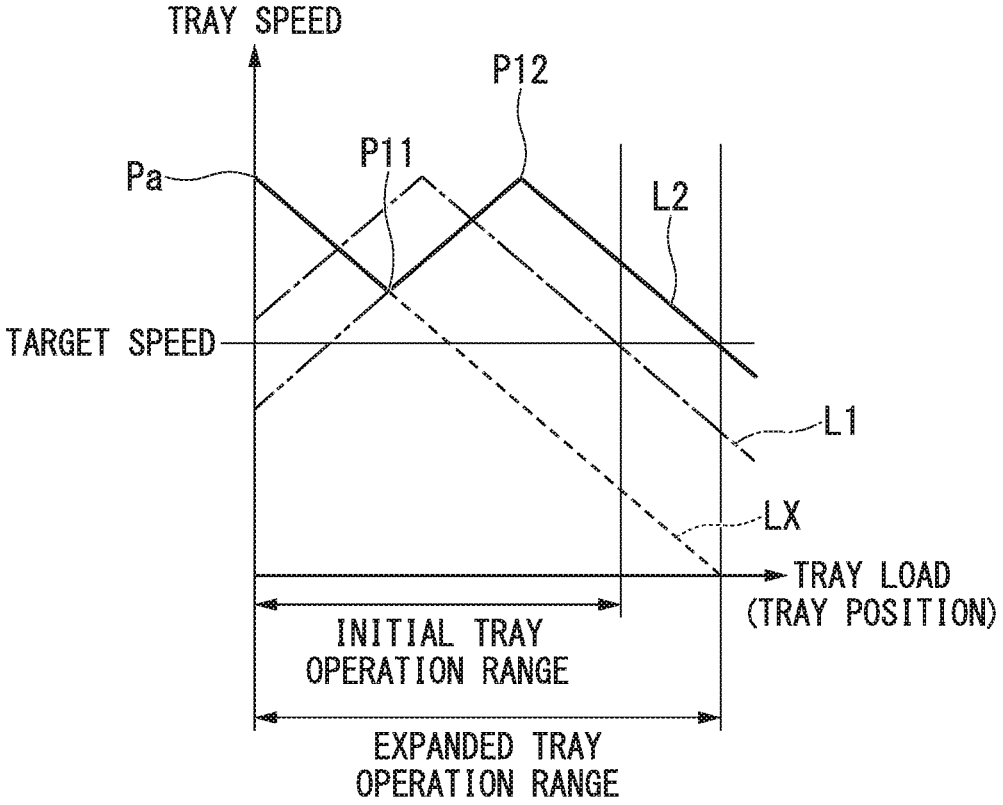
FIG. 12 is a view for describing an effect of the load reducing mechanism according to the first modified example of the embodiment.

FIGS. 10 to 12 are views for describing the effect of the load reducing mechanism 6A according to the first modified example of the embodiment.

In FIGS. 10 and 12, the horizontal axis represents a tray load (tray position) and the vertical axis represents a tray speed. In FIG. 11, the horizontal axis represents a tray load (tray position) and the vertical axis represents power consumption. In FIGS. 10 to 12, a solid line L2 indicates a case (the first modified example) in which the load reducing mechanism 6A is provided.

On the other hand, a one-dot chain line L1 indicates a case in which the switching mechanism 50 is not provided, and a broken line LX indicates a case in which the load reducing mechanism 6A is not provided (comparative example). The tray speeds shown in FIGS. 10 and 12 are average values assuming the raising/lowering motion of the sheet discharge tray 2.

As shown in FIG. 10, in the case of the first modified example (see the solid line L2), the tray speed becomes lower as the tray load grows higher from a starting point Pa, and then becomes higher as the tray load grows higher after passing through a first turning point P11. Further, the tray speed becomes lower as the tray load grows higher after passing through a second turning point P12.

In the case of the first modified example (see the solid line L2), in the state without a tray load (see FIG. 9A), since a reverse load of the constant load spring 43 is not transmitted to the sheet discharge tray 2, it becomes the state of the point Pa in FIG. 10.

The point P11 in FIG. 10 (the first turning point) corresponds to a state in which the switching stopper 52 is in contact with the inner upper surface of the switching base 53 (see FIG. 9B).

The point P12 in FIG. 10 (the second turning point) corresponds to a state in which the switching base 53 moves upward together with the switching stopper 52 (see FIG. 9C). That is, the point P12 in FIG. 10 indicates a state in which the reverse load due to the constant load spring 43 is transmitted to the sheet discharge tray 2.

A point Pb in FIG. 10 is a point on a higher tray load side than the point P12.

The load reducing mechanism 6A switches to the reverse load transmission state at a timing at which the load generated on the sheet discharge tray 2 due to the stacking of sheets and a subtraction load obtained by subtracting the load generated on the sheet discharge tray from the reverse load are equal. For example, an operation range of the switching stopper 52 in the inner space 53*a* of the switching base 53 is set so that the point P11 in FIG. 10 is an intersection point of the solid line L1 and the broken line LX in FIG. 6.

According to the first modified example, the sheet discharge tray 2 can be easily operated at the target speed in the low load state as compared with the example in FIG. 6. For example, by setting the tray operation range as in FIG. 10, it is possible to maintain the tray speed equal to or higher than the target speed over the entire tray operation range.

The graph of FIG. 11 shows an inverted relationship with the graph of FIG. 10.

As shown in FIG. 11, in the case of the first modified example (see the solid line L2), power consumption increases as the tray load increases from the starting point Pa, and decreases as the tray load increases after passing through the first turning point P11. Further, the power consumption increases as the tray load increases after passing through the second turning point P12.

In FIGS. 10 and 11, the second turning point P12 is a point at which the tray load and the reverse load are balanced.

According to the first modified example, power consumption is easily reduced in the low load state as compared with the example of FIG. 7.

For example, by setting the tray operation range as in FIG. 11, it is possible to reduce the power consumption over the entire tray operation range.

In the graph of FIG. 12, the reverse load of the constant load spring 43 is increased with respect to the graph of FIG. 10, and the tray operation range is expanded while moving the relationship between the tray load and the tray speed to the high load side.

When the reverse load of the constant load spring 43 increases, the tray speed in the low load state decreases. In the first modified example, since the tray speed in the low load state can be increased, the reverse load of the constant load spring 43 can be increased. Therefore, the tray operation range can be expanded.

For example, by setting the expanded tray operation range as in FIG. 12, it is possible to maintain the tray speed equal to or higher than the target speed in a wider range than the example of FIG. 10.

According to the first modified example, since the load reducing mechanism 6A includes the switching mechanism 50 capable of switching between the reverse load non-transmission state and the reverse load transmission state, the following effects are achieved. It is possible to easily operate the sheet discharge tray 2 at the target speed in the low load state, and power consumption can be easily reduced.

Further, the load reducing mechanism 6A achieves the following effects by switching to the reverse load transmission state at the timing at which the load generated on the sheet discharge tray 2 due to stacking of the sheets and a subtraction load obtained by subtracting the load generated on the sheet discharge tray from the reverse load are equal. Since it is possible to avoid a sudden change in tray speed, it is possible to smoothly switch between the reverse load non-transmission state and the reverse load transmission state.

A second modified example of the embodiment will be described with reference to FIGS. 13A to 14.

Figure 13A:
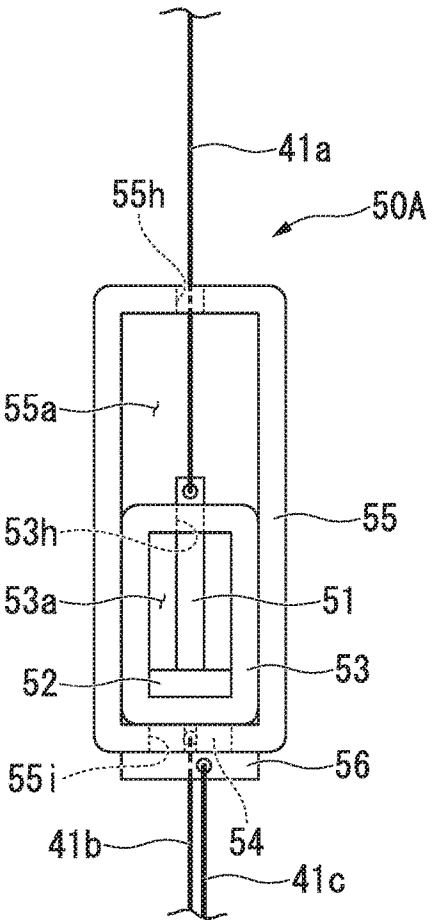
FIG. 13A is a front view showing a configuration of a switching mechanism according to a second modified example of the embodiment.

FIG. 13A is a front view showing a configuration of a switching mechanism 50A according to the second modified example of the embodiment.

As shown in FIG. 13A, the switching mechanism 50A is a two-stage switching mechanism having two switching bases 53 and 55.

In other words, the switching mechanism 50A according to the second modified example further includes a second switching base 55 in addition to the switching bar 51, the switching stopper 52, and the switching base 53 according the first modified example. In the second modified example, the switching mechanism 50A is attached to three wires 41*a*, 41*b*, and 41*c*. The three wires 41*a*, 41*b*, and 41*c* are the first wire 41*a*, the second wire 41*b*, and the third wire 41*c*.

One end (upper end) of the second wire 41*b* is attached to the second wire connector 54. The other end (lower end) of the second wire 41*b* is attached to a first constant load spring (not shown). The other end (lower end) of the third wire 41*c* is attached to a second constant load spring (not shown). The first constant load spring and the second constant load spring may be constant load springs having the same reverse load as each other and may be constant load springs having reverse loads different from each other.

The second switching base 55 is a rectangular frame-shaped member that longitudinally extends in the vertical direction. A force is applied to the second switching base 55 to be directed to a regular position by a force-applying member (not shown). An inner space 55*a* of the second switching base 55 has a size that allows the switching base 53 to move vertically.

An upper through hole 55*h* which is vertically opened is formed at an upper end of the second switching base 55.

The upper through hole 55*h* through which the switching bar 51 is inserted has a size that allows the switching bar 51 to move vertically.

A lower through hole 55*i* which is vertically opened is formed at a lower end of the second switching base 55.

The lower through hole 55*i* is capable of accommodating the second wire connector 54 and has a size that allows the second wire connector 54 to move vertically (move forward and backward).

A third wire connector 56 to which an upper end of the third wire 41*c* is attached is provided at a lower end of the second switching base 55.

An operation of the switching mechanism 50A will be described.

Figure 13B:
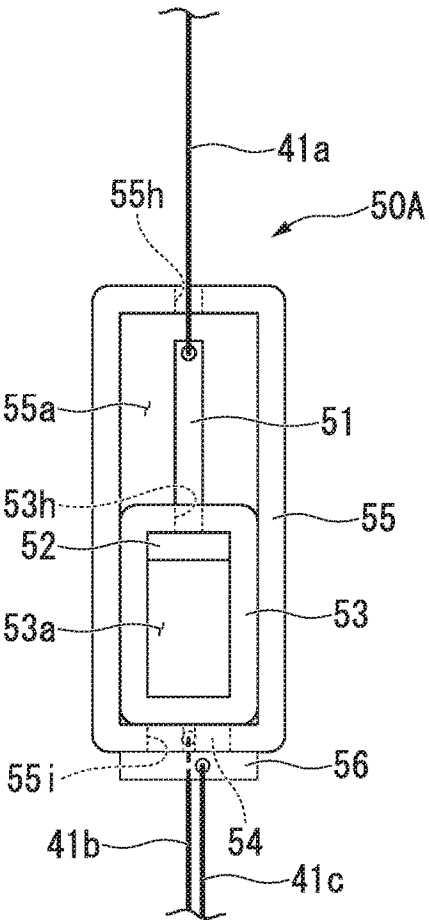
FIG. 13B is a view for describing an operation of the switching mechanism according to the second modified example of the embodiment.
Figure 13C:
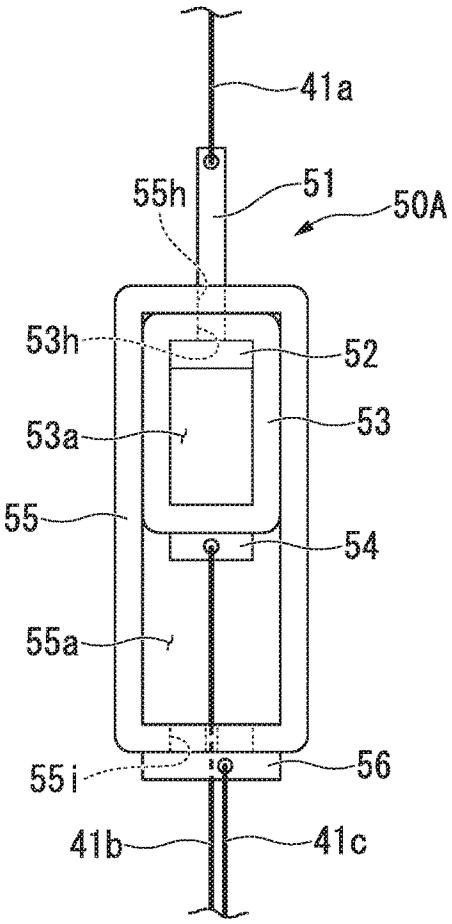
FIG. 13C is a view for describing an operation of the switching mechanism according to the second modified example of the embodiment.

FIGS. 13B and 13C are views for describing the operation of the switching mechanism 50A according to the second modified example of the embodiment.

In a state without a tray load, as shown in FIG. 13A, the switching stopper 52 is in contact with the inner lower surface of the switching base 53. In addition, in the state without a tray load, the switching bar 51 is in a state in which it is accommodated in the inner space 53*a* of the switching base 53.

When the sheet discharge tray 2 is moved downward from the state without a tray load, the switching base 53 does not move at the beginning. That is, in the initial stage of moving the sheet discharge tray 2 downward, only the switching bar 51 and the switching stopper 52 move upward. When the sheet discharge tray 2 is continuously moved downward, the switching stopper 52 comes into contact with the inner upper surface of the switching base 53 as shown in FIG. 13B.

When the sheet discharge tray 2 is further moved downward from the state in which the switching stopper 52 is in contact with the inner upper surface of the switching base 53, the switching base 53 moves upward together with the switching stopper 52 as shown in FIG. 13C. When the switching base 53 moves upward, a reverse load due to the first constant load spring is transmitted to the sheet discharge tray 2. When the sheet discharge tray 2 is continuously moved downward, the switching base 53 comes into contact with the inner upper surface of the second switching base 55.

When the sheet discharge tray 2 is further moved downward from the state in which the switching base 53 is in contact with the inner upper surface of the second switching base 55, the second switching base 55 moves upward together with the switching base 53.

When the second switching base 55 moves upward, a reverse load due to the second constant load spring is transmitted to the sheet discharge tray 2 in addition to the first constant load spring. That is, by moving the second switching base 55 upward, the reverse load due to both the first constant load spring and the second constant load spring is transmitted to the sheet discharge tray 2. Hereinafter, the reverse load due to both the first constant load spring and the second constant load spring is also referred to as a "combined reverse load".

An effect of the load reducing mechanism according to the second modified example of the embodiment will be described with reference to FIG. 14.

Figure 14:
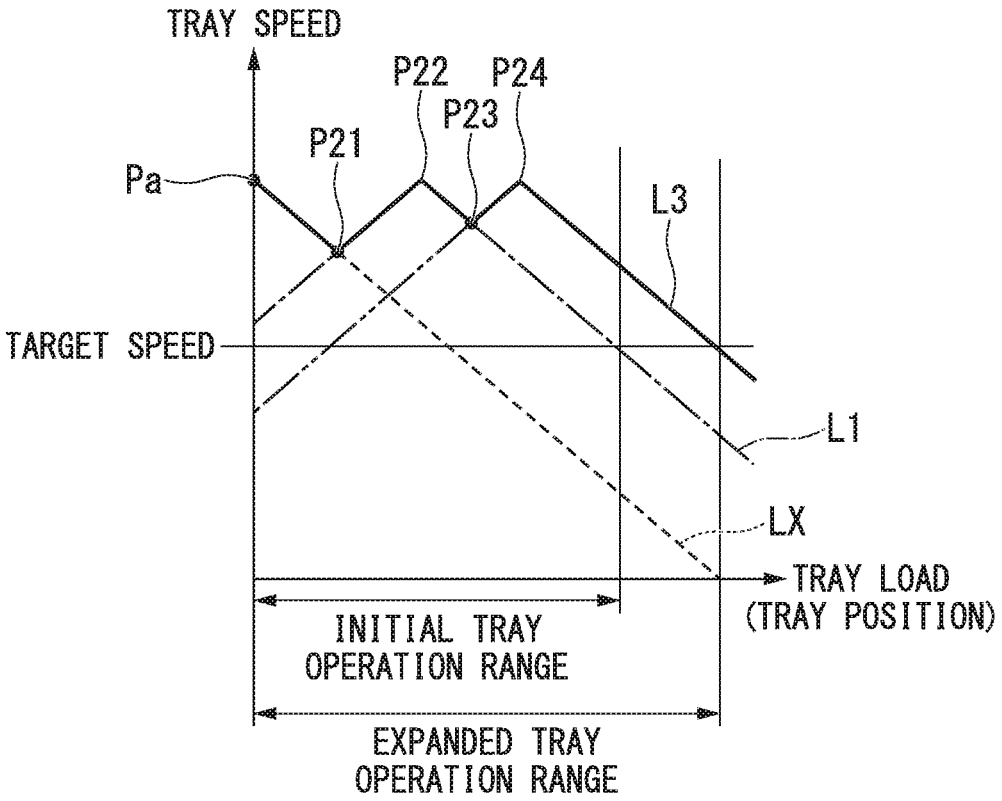
FIG. 14 is a view for describing an effect of a load reducing mechanism according to the second modified example of the embodiment.

FIG. 14 is a view for describing the effect of the load reducing mechanism according to the second modified example of the embodiment.

In FIG. 14, the horizontal axis represents a tray load (tray position) and the vertical axis represents a tray speed. In FIG. 14, a solid line L3 indicates a case (the second modified example) in which the load reducing mechanism (two-stage switching mechanism 50A) of the second modified example is provided. On the other hand, a broken line LX indicates a case (a comparative example) in which the load reducing mechanism is not provided, a one-dot chain line L1 indicates a case in which the switching mechanism 50A is not provided, and a two-dot chain line indicates a case in which the reverse load of the one-dot chain line L1 is increased. Tray speeds shown in FIG. 14 are average values assuming the raising/lowering motion of the sheet discharge tray 2.

As shown in FIG. 14, in the case of the second modified example (see the solid line L3), the tray speed becomes lower as the tray load grows higher from a starting point Pa, and then becomes higher as the tray load grows higher after passing through a first turning point P21. Further, the tray speed becomes lower as the tray load grows higher after passing through a second turning point P22. Further, the tray speed becomes higher as the tray load grows higher after passing through a third turning point P23. Further, the tray speed becomes lower as the tray load grows higher after passing through a fourth turning point P24.

In the case of the second modified example (see the solid line L3), in a state without a tray load (see FIG. 13A), since a reverse load of the first constant load spring is not transmitted to the sheet discharge tray 2, it becomes the state of the point Pa in FIG. 14.

The point P21 in FIG. 14 (the first turning point) corresponds to a state in which the switching stopper 52 is in contact with the inner upper surface of the switching base 53 (see FIG. 13B).

The point P22 in FIG. 14 (the second turning point) corresponds to a state in which the switching base 53 moves upward together with the switching stopper 52. That is, the point P22 in FIG. 14 is a state in which the reverse load due to the first constant load spring is transmitted to the sheet discharge tray 2. The point P22 is a state in which the reverse load due to the first constant load spring and the tray load are balanced.

The point P23 in FIG. 14 (the third turning point) corresponds to a state in which the switching base 53 is in contact with the inner upper surface of the second switching base 55 (see FIG. 13C). For example, an operation range of the switching base 53 in the inner space 53*a* of the second switching base 55 is set so that the point P23 in FIG. 14 is an intersection point of the solid line L2 and the one-dot chain line L1 in FIG. 12.

The point P24 in FIG. 14 (the fourth turning point) corresponds to a state in which the second switching base 55 moves upward together with the switching base 53. That is, the point P24 in FIG. 14 is a state in which the combined reverse load of the first constant load spring and the second constant load spring is transmitted to the sheet discharge tray 2. The point P24 is a state in which the combined reverse load and the tray load are balanced.

According to the second modified example, the sheet discharge tray 2 can be easily operated at the target speed in the low load state as compared with the example in FIG. 6. For example, by setting expanded tray operation range as in FIG. 14, it is possible to maintain the tray speed equal to or higher than the target speed in the wider range than in the example of FIG. 10.

According to the second modified example, since the switching mechanism 50A is the two-stage switching mechanism having two switching bases 53 and 55, the load reducing mechanism 6 achieves the following effects. It is possible to easily operate the sheet discharge tray 2 at the target speed in the low load state, and power consumption can be easily reduced.

In the second modified example described above, the case in which the switching mechanism 50A is the two-stage switching mechanism having two switching bases 53 and 55 has been described. However, it is not limited thereto, and the switching mechanism 50A may be a multi-stage switching mechanism having three or more switching bases.

A third modified example of the embodiment will be described with reference to FIGS. 15 to 17.

Figure 15:
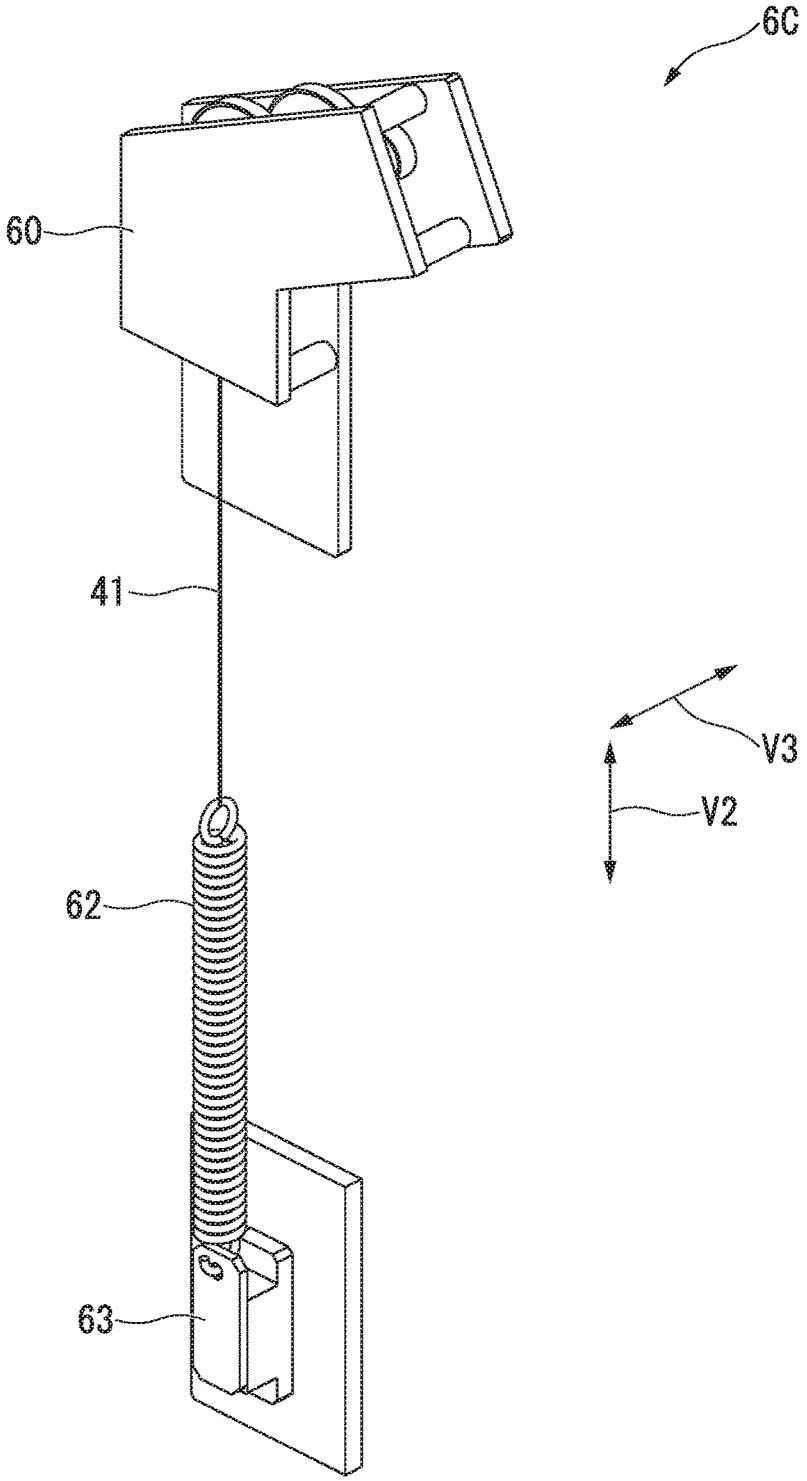
FIG. 15 is a perspective view showing a configuration of a load reducing mechanism according to a third modified example of the embodiment.

FIG. 15 is a perspective view showing a configuration of a load reducing mechanism 6C according to the third modified example of the embodiment.

As shown in FIG. 15, the load reducing mechanism 6C may include a linear spring 62 instead of the constant load spring. The load reducing mechanism 6C may change a magnitude of the reverse load provided to the sheet discharge tray 2 according to a magnitude of the load generated on the sheet discharge tray 2 (see FIG. 1). That is, the load reducing mechanism 6C may change the magnitude of the reverse load provided to the sheet discharge tray 2 according to a position of the sheet discharge tray 2.

The load reducing mechanism 6C includes a speed reducer box 60, the wire 41, the linear spring 62, and a spring fixer 63.

The speed reducer box 60 includes a gear, a gear train, and a wire pulley which are not shown.

The gear is attached to the worm wheel shaft 16 (see FIG. 2).

The gear train engages with the gear.

The wire pulley is coaxially connected with a final stage of the gear train.

An upper end of the wire 41 is attached to the wire pulley. The wire 41 is wound on the wire pulley. A lower end of the wire 41 is attached to an upper end of the linear spring 62.

The linear spring 62 is a spring of which a reaction force varies according to a displacement amount of the sheet discharge tray 2. For example, the linear spring 62 is a tension spring. The linear spring 62 is not limited to the tension spring, but may be a compression spring.

A lower end of the linear spring 62 is attached to the spring fixer 63. The linear spring 62 provides a reverse load to the sheet discharge tray 2. When the sheet discharge tray 2 moves downward, the linear spring 62 is pulled, and an upward force acts on the sheet discharge tray 2. It is preferable that a spring constant of the linear spring 62 be set considering relationships among a movement amount dz of the sheet discharge tray 2 in the downward direction, a magnitude of the load acting on the sheet discharge tray 2, and a magnitude dw of the reverse load provided to the sheet discharge tray 2.

An effect of the load reducing mechanism 6C according to the third modified example of embodiment will be described with reference to FIGS. 16 and 17.

Figure 16:
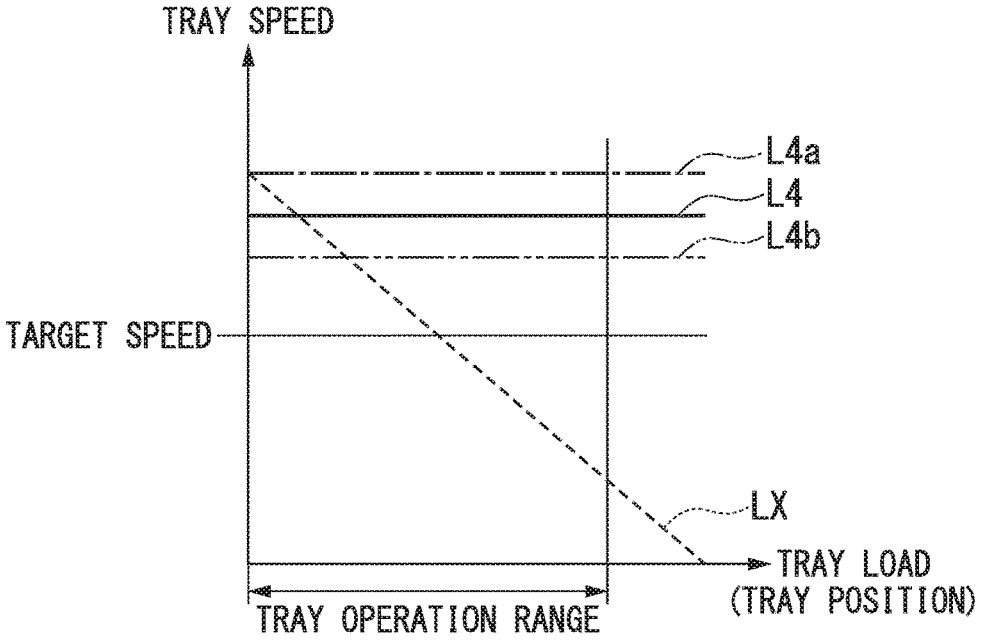
FIG. 16 is a view for describing an effect of the load reducing mechanism according to the third modified example of the embodiment.
Figure 17:
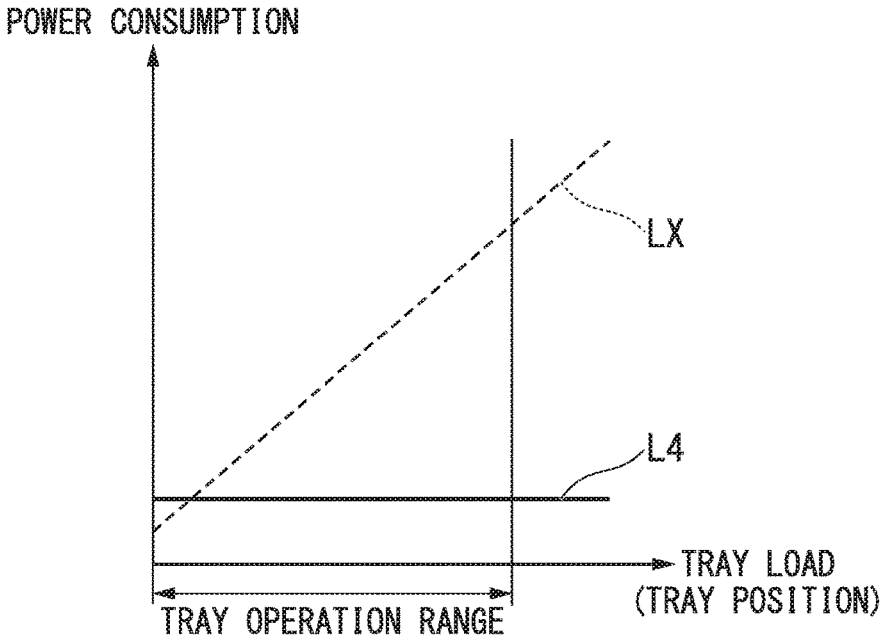
FIG. 17 is a view for describing an effect of the load reducing mechanism according to the third modified example of the embodiment.

FIGS. 16 and 17 are views for describing the effect of the load reducing mechanism 6C according to the third modified example of embodiment. In FIG. 16, the horizontal axis represents a tray load (tray position) and the vertical axis represents a tray speed. In FIG. 17, the horizontal axis represents a tray load (tray position) and the vertical axis represents power consumption. In FIGS. 16 and 17, a solid line L4 indicates a case (the third modified example) in which the load reducing mechanism 6C is provided. On the other hand, a broken line LX indicates a case in which the load reducing mechanism 6C is not provided. Tray speeds shown in FIG. 16 are average values assuming the raising/lowering motion of the sheet discharge tray 2.

As shown in FIG. 16, in the case of the third modified example (see the solid line L4), since displacement of the linear spring 62 varies depending on the position of the sheet discharge tray 2, a magnitude of the reverse load varies. A state in which the tray load and the reverse load are balanced is the relationship indicated by a one-dot chain line L4*a* in FIG. 16. When the sheet discharge tray 2 moves up and down from the state of the one-dot chain line L4*a*, a relationship indicated by a two-dot chain line L4*b* in FIG. 6 is obtained. Therefore, when the one-dot chain line L4*a* and the two-dot chain line L4*b* are averaged, a relationship indicated by the solid line L4 is obtained.

According to the third modified example, the sheet discharge tray 2 can be easily operated at the target speed as compared with the configuration having the constant load spring. For example, by setting a tray operation range as in FIG. 16, it is possible to maintain the tray speed equal to or higher than the target speed over the entire tray operation range.

The graph of FIG. 17 shows an inverted relationship with the graph of FIG. 16.

As shown in FIG. 17, in the case of the third modified example (see the solid line L4), power consumption is constant regardless of whether the tray load is high or low.

According to the third modified example, power consumption can be reduced as compared with the configuration having the constant load spring. For example, by setting the tray operation range as in FIG. 17, it is possible to reduce the power consumption over the entire tray operation range According to the third modified example, since the load reducing mechanism 6C changes the magnitude of the reverse load provided to the sheet discharge tray 2 according to the magnitude of the load generated on the sheet discharge tray 2, the following effects are achieved. It is possible to stably maintain the tray speed equal to or higher than the target speed and stably reduce the power consumption as compared with the case in which a constant reverse load is provided to the sheet discharge tray 2 regardless of the magnitude of the load generated on the sheet discharge tray 2.

In addition, the load reducing mechanism 6C, by having the linear spring 62 of which the reaction force varies according to a displacement amount of the sheet discharge tray 2, achieves the following effects. By setting the linear spring 62 to have a spring constant corresponding to a relationship between the tray position and sheet stacking amount, it is possible to stably maintain the tray speed equal to or higher than the target speed and stably reduce the power consumption as compared with the configuration having a constant load spring.

In the third modified example described above, the case in which a switching mechanism is not provided in the load reducing mechanism 6C has been described. However, it is not limited thereto, and the load reducing mechanism 6C may further include a switching mechanism.

Another modified example of the embodiment will be described.

In the embodiment described above, the case in which the sheet post-processing apparatus 1 includes the power transmission cut-off mechanism 30 has been described. However, it is not limited thereto, and the sheet post-processing apparatus 1 may not include the power transmission cut-off mechanism 30.

Further, in the embodiment described above, the case in which the power transmission cut-off mechanism 30 includes the ratchet gear 31 that restricts downward movement of the sheet discharge tray 2 when an upward external force is applied to the sheet discharge tray 2 has been described. However, it is not limited thereto, and the power transmission mechanism may include an external force detection sensor and an electromagnetic clutch.

The external force detection sensor detects an external force applied to the sheet discharge tray 2 (see FIG. 1).

When the external force exceeds the threshold value, the electromagnetic clutch restricts the downward movement of the sheet discharge tray 2 according to the detection result of the external force detection sensor.

According to the present modified example, when an external force applied to the sheet discharge tray 2 exceeds the threshold value, a moving direction of the sheet discharge tray 2 is restricted upward by the electromagnetic clutch. Therefore, it is possible to more effectively prevent the sheet discharge tray 2 from being pinched by an obstacle thereunder.

In the switching mechanism of the embodiment described above, the case in which power transmission is mechanically switched has been described. However, it is not limited thereto, and switching of the power transmission may be performed in a controlled manner.

For example, the sheet post-processing apparatus may include a position sensor and a switching controller. The position sensor detects a tray position. According to the detection result of the position sensor, the switching controller controls the switching mechanism to be in the reverse load transmission state when the tray position is higher than a predetermined position.

According to the detection result of the position sensor, the switching controller controls the switching mechanism to be in the reverse load non-transmission state when the tray position is lower than a predetermined position.

According to the present modified example, since the transmission and non-transmission of the reverse load with respect to the sheet discharge tray 2 are switchable according to a vertical position of the sheet discharge tray 2, it is possible to efficiently utilize an assisting force of the drive motor 4 by the tray load when the tray position is low. In addition, it is possible to utilize assistance of the reverse load when the tray position is high. Therefore, power consumption can be reduced.

For example, the sheet post-processing apparatus may include an operating direction detection sensor and a switching controller. The operating direction detection sensor detects an operating direction of the sheet discharge tray 2. According to a detection result of the operating direction detection sensor, the switching controller controls the switching mechanism to be in the reverse load transmission state when the sheet discharge tray 2 is rising. According to the detection result of the operating direction detection sensor, the switching controller controls the switching mechanism to be in the reverse load non-transmission state when the sheet discharge tray 2 is lowered.

According to the present modified example, since the transmission and non-transmission of the reverse load to the sheet discharge tray 2 are switchable corresponding to the raising and lowering of the sheet discharge tray 2, it is possible to efficiently utilize the assisting force of the drive motor 4 due to the tray load when the sheet discharge tray 2 is lowered. In addition, it is possible to utilize the assistance of the reverse load when the sheet discharge tray 2 is rising. Therefore, power consumption can be reduced.

According to at least one embodiment described above, it is possible to provide the sheet post-processing apparatus 1 which includes the sheet discharge tray 2 capable of stacking discharged sheets, the drive motor 4 that raises and lowers the sheet discharge tray 2, the power transmission cut-off mechanism 30 that cuts off power transmission from the drive motor 4 to the sheet discharge tray 2 when an upward external force is applied to the sheet discharge tray 2, the first power transmitter 10 that transmits power from the drive motor 4 to the power transmission cut-off mechanism 30, the second power transmitter 20 that transmits power from the power transmission cut-off mechanism 30 to the sheet discharge tray 2, and the load reducing mechanism 6 that provides a reverse load to the sheet discharge tray 2 in a reverse direction to the load generated on the sheet discharge tray 2 due to the stacking of the sheets, wherein the load reducing mechanism 6, by being connected to the first power transmitter 10, can prevent the sheet discharge tray 2 from being pinched by an obstacle thereunder while reducing the size of the drive motor 4.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A sheet post-processing apparatus comprising:

a sheet discharge tray that stacks sheets;

a drive motor that raises and lowers the sheet discharge tray;

a power transmission breaker that is capable of cutting off power transmission from the drive motor to the sheet discharge tray when an upward external force is applied to the sheet discharge tray;

a first power transmitter that transmits power from the drive motor to the power transmission breaker;

a second power transmitter that transmits power from the power transmission breaker to the sheet discharge tray; and a load reducer connected to the first power transmitter and configured to provide a reverse load to the sheet discharge tray in a reverse direction to the load generated on the sheet discharge tray due to stacking of the sheets.

2. The sheet post-processing apparatus according to claim 1, wherein the power transmission breaker includes a ratchet gear that restricts downward movement of the sheet discharge tray when the upward external force is applied to the sheet discharge tray.

3. The sheet post-processing apparatus according to claim 1, wherein the power transmission breaker includes:

an external force detection sensor that detects an external force applied to the sheet discharge tray; and an electromagnetic clutch that restricts downward movement of the sheet discharge tray according to a detection result of the external force detection sensor when the external force exceeds a threshold value.

4. The sheet post-processing apparatus according to claim 1, wherein the first power transmitter includes:

a worm gear rotationally driven by the drive motor;

a worm wheel with which the worm gear engages;

a worm wheel shaft, to which the worm wheel is attached, having a twisted positional relationship with a shaft of the worm gear; and a gear attached to the worm wheel shaft and connected to the power transmission breaker.

5. The sheet post-processing apparatus according to claim 4, wherein the load reducer is connected to the worm wheel shaft.

6. The sheet post-processing apparatus according to claim 1, wherein the load reducer includes a switcher that switches between a reverse load non-transmission state in which the reverse load is not transmitted to the sheet discharge tray and a reverse load transmission state in which the reverse load is transmitted to the sheet discharge tray.

7. The sheet post-processing apparatus according to claim 6, wherein the load reducer switches to the reverse load transmission state at a timing at which a load generated on the sheet discharge tray due to stacking of the sheets and a subtraction load obtained by subtracting the load generated on the sheet discharge tray from the reverse load are equal.

8. The sheet post-processing apparatus according to claim 1, wherein the load reducer includes a constant load spring that provides a constant reverse load to the sheet discharge tray regardless of a magnitude of the load generated on the sheet discharge tray.

9. The sheet post-processing apparatus according to claim 1, wherein the load reducer changes a magnitude of the reverse load provided to the sheet discharge tray according to the magnitude of the load generated on the sheet discharge tray.

10. The sheet post-processing apparatus according to claim 9, wherein the load reducer includes a spring of which a reaction force varies according to a displacement amount of the sheet discharge tray.

11. The sheet post-processing apparatus according to claim 1, wherein the first power transmitter includes:

a worm gear rotationally driven by the drive motor; and a worm wheel with which the worm gear engages.

12. A sheet post-processing apparatus comprising:

a sheet discharge tray that stacks sheets;

a drive motor that raises and lowers the sheet discharge tray;

a power transmitter that transmits power from the drive motor to the sheet discharge tray; and a load reducer that provides a reverse load to the sheet discharge tray in a reverse direction to the load generated on the sheet discharge tray due to stacking of the sheets, wherein the power transmitter includes a first power transmitter and a second power transmitter having a reduction gear ratio lower than that of the first power transmitter, and the load reducer is connected to the first power transmitter.

13. The sheet post-processing apparatus according to claim 12, further comprising a power transmission breaker that cuts off power transmission from the drive motor to the sheet discharge tray when an upward external force is applied to the sheet discharge tray.

14. The sheet post-processing apparatus according to claim 13, wherein the power transmission breaker includes a ratchet gear that restricts downward movement of the sheet discharge tray when an upward external force is applied to the sheet discharge tray.

15. The sheet post-processing apparatus according to claim 13, wherein the power transmission breaker includes:

an external force detection sensor that detects an external force applied to the sheet discharge tray; and an electromagnetic clutch that restricts downward movement of the sheet discharge tray according to a detection result of the external force detection sensor when the external force exceeds a threshold value.

16. The sheet post-processing apparatus according to claim 13, wherein the first power transmitter includes:

a worm gear rotationally driven by the drive motor;

a worm wheel with which the worm gear engages;

a worm wheel shaft, to which the worm wheel is attached, having a twisted positional relationship with a shaft of the worm gear; and a gear attached to the worm wheel shaft and connected to the power transmission breaker.

17. The sheet post-processing apparatus according to claim 16, wherein the load reducer is connected to the worm wheel shaft.

18. The sheet post-processing apparatus according to claim 12, wherein the load reducer includes a switcher that switches between a reverse load non-transmission state in which the reverse load is not transmitted to the sheet discharge tray and a reverse load transmission state in which the reverse load is transmitted to the sheet discharge tray.

19. The sheet post-processing apparatus according to claim 18, wherein the load reducer switches to the reverse load transmission state at a timing at which a load generated on the sheet discharge tray due to stacking of the sheets and a subtraction load obtained by subtracting the load generated on the sheet discharge tray from the reverse load are equal.

20. The sheet post-processing apparatus according to claim 12, wherein the load reducer includes a constant load spring that provides a constant reverse load to the sheet discharge tray regardless of a magnitude of the load generated on the sheet discharge tray.

* * * * *